US006845572B1

(12) United States Patent
Haimerl et al.

(10) Patent No.: US 6,845,572 B1
(45) Date of Patent: Jan. 25, 2005

(54) SEALED SHOE AND A METHOD FOR THE PRODUCTION THEREOF

(76) Inventors: Franz Haimerl, Egerlaenderstr. 2, D-Iffeldorf 82393 (DE); Alfons Meindl, Rosenstr. 6, D-83417 Kirchanschoering (DE)

( * ) Notice: Subject to any disclaimer, the term of this patent is extended or adjusted under 35 U.S.C. 154(b) by 0 days.

(21) Appl. No.: 09/830,818

(22) PCT Filed: Oct. 28, 1999

(86) PCT No.: PCT/EP99/08188

§ 371 (c)(1),
(2), (4) Date: Sep. 4, 2001

(87) PCT Pub. No.: WO00/24279

PCT Pub. Date: May 4, 2000

(30) Foreign Application Priority Data

Oct. 28, 1998 (DE) ..... 298 19 186 U
Jan. 29, 1999 (DE) ..... 199 03 630

(51) Int. Cl.[7] ..... A43C 13/08
(52) U.S. Cl. ..... 36/12; 36/19.5
(58) Field of Search ..... 36/12, 17 R, 19.5, 36/22 R, 30 R

(56) References Cited

U.S. PATENT DOCUMENTS

| | | | | |
|---|---|---|---|---|
| 1,922,430 | A | 8/1933 | Game | 121/142 |
| 2,450,666 | A | 10/1948 | Kamborian | 12/142 |

(List continued on next page.)

FOREIGN PATENT DOCUMENTS

| | | | |
|---|---|---|---|
| DE | 213100 | | 1/1909 |
| DE | 3712901 | C | 8/1988 |
| DE | 3820094 | A | 12/1989 |
| DE | 4002667 | | 6/1991 |
| DE | 4000156 | A | 7/1991 |
| DE | 4311768 | | 10/1994 |
| DE | 4433870 | A | 3/1996 |
| DE | 4436495 | A | 4/1996 |
| DE | 19627030 | A | 1/1998 |
| EP | 0 223 562 | | 5/1987 |
| EP | 284638 | | 10/1988 |
| EP | 0736265 | A | 10/1996 |
| EP | 862867 | | 9/1998 |
| WO | WO 90/06067 | A | 6/1990 |

OTHER PUBLICATIONS

International Search Report for PCT/EP99/08188 (2 pages).

*Primary Examiner*—M. D. Patterson
(74) *Attorney, Agent, or Firm*—Kevin J. Boland

(57) ABSTRACT

The invention relates to footwear comprising a shank (11) and a sole construction having an outsole (19). The shank (11) is constructed with an upper material (13) and with a water-tight functional layer (15) which at least partially lines the upper material (13) on the inner side thereof. In addition, the shank comprises a shank end area (61) which is situated on the side of the sole and which has an upper material end area (21) and a functional layer end area (23). The functional layer end area (23) comprises an area which requires sealing, and the outsole (19) is glued to the shank end area (61) by means of an outsole adhesive situated on said outsole. The outsole adhesive is formed by a reactive hot-melt adhesive is formed by a reactive hot-melt adhesive **(33, 33*a*) at least in one outsole partial area located opposite the area of the functional end area (23)** which requires sealing. Said hot-melt adhesive leads to water impermeability when completely reacted.

50 Claims, 27 Drawing Sheets

U.S. PATENT DOCUMENTS 3,605,290 A 9/1971 Eder et al. ..... 36/2.5
4,894,277 A * 1/1990 Akasaki ..... 428/198
5,285,546 A * 2/1994 Haimerl ..... 12/142 E
5,329,807 A 7/1994 Sugar et al. ..... 73/40
5,599,895 A 2/1997 Heider ..... 528/59
5,605,717 A * 2/1997 Simmons et al. ..... 427/208.2
5,616,625 A * 4/1997 Hung et al. ..... 521/79
5,678,326 A * 10/1997 Pavelescu ..... 36/14
5,689,903 A * 11/1997 Aumann ..... 36/77 R
5,711,093 A * 1/1998 Aumann ..... 36/77 R
5,820,719 A * 10/1998 Strickland et al. ..... 156/245
5,918,382 A 7/1999 Haderlein et al. ..... 36/14
5,943,791 A 8/1999 Pavelescu et al. ..... 36/14
5,983,527 A * 11/1999 Strickland et al. ..... 36/12
6,035,555 A * 3/2000 Pavelescu et al. ..... 36/14
6,136,136 A 10/2000 Heider ..... 156/331.4

* cited by examiner

Fig.

SEALED SHOE AND A METHOD FOR THE PRODUCTION THEREOF

FIELD OF THE INVENTION

The invention relates to a shoe sealing system and a sealing method for a sealed shoe with an upper and an insole, to which the upper is joined, and in particular footwear with an upper, which is provided at least partially with a waterproof functional layer which is preferably water-vapour permeable, and with a cemented-on outsole. The invention also relates to a process for the production of such a shoe.

BACKGROUND OF THE INVENTION

There are shoes that are impermeable in the region of the upper, for example as a result of lining the outer material of the upper with a waterproof layer. This is preferably a waterproof, water-vapour-permeable functional layer, by means of which waterproofness is achieved while maintaining breathability, i.e. water-vapour permeability. The functional layer is often part of a functional layer laminate that has in addition to the functional layer at least one textile layer.

Shoes of this type are either equipped with a functional layer in the form of a so-called bootee, which lines the entire interior of the shoe, or only the upper is lined with a functional layer. In the latter case, special efforts are required to ensure permanent waterproofness in the region between the end of the upper on the sole side and the sole construction.

In shoes which are produced by the known cement-lasting process, the upper of the shoe is cemented to the underside of the insole along a border region, which is referred to as the lasting allowance, and an outsole is applied to the underside of this cemented unit. This construction has weak points. Weak points are, in particular, points at which the contour of the shoe has a small radius of curvature and folds of the lasted upper material occur in the lasting allowance, because the lasting cement either does not seal the entire transitional region between the upper of the shoe and the insole from the outset, in particular in the region of the lasting folds, or becomes brittle and consequently water-permeable as a result of flexural stresses during use of the shoe.

It is known from DE 40 00 156 A to arrange reactivatable sealing cement, which may be silicone or polyurethane, between the periphery of the insole and the functional layer of the upper. To prevent water which reaches the underside of the insole via the outer material of the upper and the lasting allowance from being able to get into the space inside the shoe, the insole is provided with a waterproof insole layer. There may be cases in which the separate, additional step of cementing the periphery of the insole to the functional layer and the use of a waterproof insole are not desired.

EP 0 286 853 A discloses a process for sealing the lasting allowance of a shoe upper provided with a waterproof, water-vapour permeable functional layer in which an inner border region of the lasting allowance is kept uncemented during the cement-lasting and an injection mould with a sealing lip rising up towards the lasting allowance is placed against the underside of the lasting allowance after the lasting operation. In this case, the sealing lip essentially follows the contour of the insole border and is offset slightly towards the middle of the insole with respect to the outer peripheral contour of the outsole to be applied later. A sealing material is injected into the space inside the sealing lip and surrounds the border region of the upper provided with the functional layer, left uncemented during cement-lasting, and consequently seals the said region. Although this sealing process has proved to be very successful, it requires an injection mould and an injection machine of the type mentioned.

It is known from EP 0 595 941 B to seal the lasting allowance in a shoe with an upper which has a waterproof layer and is lasted around an insole in such a way that the border of the upper region to be lasted is embedded in a waterproof material, which may be polyurethane (PU), before the lasting operation. This sealing method has also proved to be very successful, but requires the additional process step of embedding the border of the lasting allowance.

SUMMARY OF THE INVENTION

The invention provides a shoe which can be made waterproof with relatively simple means and low expenditure.

The invention is also intended to provide footwear which can be made permanently waterproof with as little expenditure on machinery as possible and with as few process steps as possible.

A sealed shoe according to a first aspect of the invention has an upper and an insole, to which the upper is joined, polyurethane-based reactive hot-melt adhesive having been applied over the surface area to the underside of the shoe in the region of the insole and the part of the upper joined to the latter and pressed. According to the invention, a process for its production is also provided, in which the upper is joined to the insole and polyurethane-based reactive hot-melt adhesive is applied over the surface area to the underside of the shoe in the region of the insole and the part of the upper joined to the latter and is pressed. Advantageous developments are specified by the dependent patent claims.

In a shoe according to the invention, polyurethane-based reactive hot-melt adhesive is applied over the surface area to the underside of the shoe in the region of the insole and the part of the upper joined to it and is pressed.

In this context, underside of the shoe means the underside of the shoe before the application of an outsole.

Reactive hot-melt adhesive is adhesive which brings about waterproofness when in the fully reacted state. In the case of a shoe according to the invention, this effects the sealing in the region of the sole construction.

In one embodiment of the invention, open-pore, adhesive-compatible material is applied over the entire shoe and the side region or parts of it. An outer material such as leather, a nonwoven, felt or the like is preferably used as such material. This material is preferably cemented flush in the reactive hot-melt adhesive. This means that the surface of the outer material facing away from the insole is essentially flush with the surface of the reactive hot-melt adhesive facing away from the insole. This achieves the effect that the underside of the shoe (in the sense defined above) has a flat and uniform surface, which facilitates the adhesive attachment of an outsole for example.

In an embodiment of the invention, the part of the upper of the shoe on the sole side is joined to the insole by cement-lasting. This means that a lasting-allowance region of the part of the upper on the sole side that has been pulled over the edge of the insole on the underside of the latter facing what will be outsole is attached on a peripheral region of the underside of the insole by adhesive bonding. After the cement-lasting, the reactive hot-melt adhesive is then applied to the underside of the shoe (in the sense specified above), in order to seal the underside of the shoe before applying an outsole.

In the case of a cement-lasted shoe, the reactive hot-melt adhesive is preferably applied over a width of about 1 cm, overlapping between the insole and the lasted upper. This achieves the effect that the inner periphery of the lasting allowance is reliably sealed by the reactive hot-melt adhesive.

In one embodiment of the invention, the reactive hot-melt adhesive is applied to the entire underside of the insole not covered by the lasting allowance and to the said overlapping region with the lasting allowance.

Consequently, in addition to the cement-lasting with a lasting cement, a further, sealing adhesive bonding with reactive hot-melt adhesive takes place in the invention.

For the production of shoes according to the invention, the customary cement-lasting method can be used without modification. To obtain waterproofness in the region of the sole construction, all that is necessary is to apply the reactive hot-melt adhesive to the underside of the shoe not yet provided with an outsole. The waterproofness is therefore achieved with very little additional expenditure.

According to a second aspect of the invention, the latter concerns footwear with an upper and a sole construction having an outsole, the upper being constructed with an outer material and with a waterproof functional layer at least partially lining the outer material on the inner side of the latter, and having an upper end region on the sole side with an outer-material end region and a functional-layer end region;

the functional-layer end region has a region requiring sealing; and the outsole is adhesively bonded to the upper end region by means of outsole cement located on it, the outsole cement being formed at least in an outsole subregion lying opposite the region requiring sealing of the functional-layer end region by a reactive hot-melt adhesive which brings about waterproofness when in the fully reacted state.

According to this aspect, the invention further concerns a process for producing such footwear with the following production steps:

a) an upper is created, constructed with an outer material and with a waterproof functional layer at least partially lining the outer material on the inner side of the latter and provided with an upper end region on the sole side;

b) the outer material is provided with an outer-material end region on the sole side and the functional layer is provided with a functional-layer end region on the sole side, creating a region requiring sealing at the functional-layer end region;

c) outsole cement is applied to an outsole and the outsole is adhesively bonded to the upper end region, a reactive hot-melt adhesive, which leads to waterproofness when in the fully reacted state, being applied as outsole cement at least in a subregion of the outsole which lies opposite the region requiring sealing of the functional-layer end region after the adhesive attachment of the outsole.

According to this aspect, the invention also concerns an outsole for adhesive attachment to an upper of footwear, the upper side of the sole thereof which is to be adhesively attached to the upper being provided at least partially with non-reacted reactive hot-melt adhesive, which leads to waterproofness when in the fully reacted state.

The two aspects of the invention may also be advantageously realized by being combined with each other.

Footwear according to the invention as specified by the second aspect is provided with an upper and with a sole construction having an outsole, the upper being constructed with an outer material and with a waterproof functional layer at least partially lining the outer material on the inner side of the latter and having an upper end region on the sole side with an outer-material end region and a functional-layer end region. The functional-layer end region has a region requiring sealing against water, from which water or another liquid that has penetrated to this region of the functional layer, in particular via the outer material and/or via a seam, could get into the space inside the shoe. A sole construction providing protection against this is made waterproof according to the invention by applying as outsole cement, at least in a subregion of the outsole which is closed in the direction of the sole periphery and lies opposite the region of the functional layer requiring sealing when the outsole has been adhesively attached, a reactive hot-melt adhesive which brings about waterproofness when in the fully reacted state. According to the invention, both the adhesive which is used for cementing the outsole to the upper end region and the reactive hot-melt adhesive which is used for sealing the functional-layer end region are applied to the top side of the outsole facing the upper end region before the outsole is pressed onto the upper end region and consequently cemented onto it.

This is a particularly simple method of sealing, for which only those process steps which are customary for shoes without a waterproof sole construction are required, with the only exception that the outsole does not have conventional outsole cement applied to it, or not only such a conventional outsole cement, but partially or entirely reactive hot-melt adhesive.

Regions requiring sealing are, in the case of footwear according to the invention, in the upper end region on the sole side of the said footwear for example an overhang of a functional-layer end region over an outer-material end region, a functional-layer end region covered by permeable outer material or an end edge of the functional layer or an end edge of the functional layer in the region of an end edge of the upper.

Conventional outsole cement is usually solvent adhesive or hot-melt adhesive, both for example polyurethane-based. Solvent adhesive is adhesive which has been made adhesive by the addition of vaporizable solvent and cures on the basis of the vaporizing of the solvent. Hot-melt adhesive is adhesive, also known as thermoplastic adhesive, which is brought into an adhesive state by heating and cures by cooling. Such adhesive can be repeatedly brought into the adhesive state by renewed heating.

If, according to one embodiment of the invention, the entire outsole is provided over its full surface area with reactive hot-melt adhesive which both has an adhesive function for cementing the outsole to the upper end region and assumes the task of sealing the functional-layer end region, all the process steps which are conventionally used for shoes without a waterproof sole construction are adequate. All that has to be done to obtain a waterproof sole construction is not to apply customary outsole cement, or not only such cement, but reactive hot-melt adhesive to the outsole.

The waterproofness of the sole construction of waterproof footwear is consequently achieved in an extremely simple way and with extremely simple process steps.

The method according to the invention is equally suitable for shoes with an insole as for shoes without an insole. In shoes with an insole, fixing of the upper end region can take place in the conventional way either by cement-lasting or by sewing to the insole, for example by means of a Strobel seam. In shoes without an insole, the fixing of the upper end region can be achieved in a known way by means of string-lasting. In all these production methods, whenever the upper end region is secured by fastening to the insole or by string-lasting after the lasting of the upper, the outsole, provided entirely or partially with reactive hot-melt adhesive, is cemented onto the upper end region and, if an insole is used, onto the underside of the insole. This simple operation of cementing-on the outsole makes the sole construction waterproof.

In an embodiment of the invention which can be used if the outer material and the functional layer are mutually independent layers of material, the functional-layer end region is provided with an overhang beyond the outer-material end region. In this case, reactive hot-melt adhesive is applied to the outsole, at least in that region which lies opposite the overhang of the functional-layer end region or at least a sub-region of this overhang, after the outsole has been cemented on.

The invention may also be used, however, if the functional-layer end region does not have an overhang beyond the outer-material end region but instead both terminate at the same cut line. This is particularly the case if a multi-layer laminate which comprises both the outer material and the functional layer is used for the upper. In this case as well, the sealing of the functional-layer end region can be achieved by applying reactive hot-melt adhesive to the outsole.

In the event that the outer material is permeable to the reactive hot-melt adhesive in its not fully reacted, liquid state, as are many textiles used as the outer material, reactive hot-melt adhesive is applied at least to that region of the outsole which lies opposite the upper end region after the said outsole has been cemented onto the upper. While the outsole is being pressed onto the upper, the reactive hot-melt adhesive penetrates the outer material and brings about a sealing adhesive bonding of the functional layer of the multi-layer laminate.

In the event that the outer material cannot be penetrated by the not fully reacted, liquid reactive hot-melt adhesive, reactive hot-melt adhesive is applied to the outsole in such a region and in such an amount and the outsole is pressed onto the upper in such a way that reactive hot-melt adhesive seals at least the cut edge of the multi-layer laminate and consequently also the cut edge of the functional layer. The procedure preferably followed in the case of this embodiment is that, when pressing on the outsole, reactive hot-melt adhesive is made to reach the rear side of the multi-layer laminate, and consequently of the functional layer, remote from the outsole. In shoes with cement-lasting, this can be assisted by leaving a border region of the upper end region adjacent to the cut edge free of lasting cement, so that in this border region the upper end region is still loose when the outsole with the reactive hot-melt adhesive applied to it is pressed onto the upper.

At least at those points at which the reactive hot-melt adhesive is to increase in volume to fill cavities, an expanded reactive hot-melt adhesive may be applied to the outsole. Expansion may be achieved by the reactive hot-melt adhesive being made to swirl by a gas, which may preferably be a mixture of nitrogen and air, during application.

In embodiments of the invention in which the functional-layer end region has an overhang beyond the outer-material end region, before cementing on the outsole the overhang may either remain free or be bridged by means of a gauze strip, one side of which is fastened to the outer-material end region and the other side of which is fastened to the border of the functional-layer end region, if an insole is used is fastened to this insole or in the case of footwear with string-lasting is fastened to this string-lasting.

In particular whenever the overhang of the functional-layer end region is not bridged by a gauze strip, the outer-material end region may be fixed to the functional layer, for example by a fixing adhesive, before cementing on the outsole, in order to facilitate the operation of cementing on the outsole.

The outsole may be flat or turned up at the edges. A flat outsole may be used whenever the upper end region is wrapped around the last in such a way that it extends essentially parallel to the tread of the outsole. An outsole with turned-up edges around its peripheral border is recommendable if the upper end region does not extend parallel to the tread of the outsole but perpendicular to it.

The use of reactive hot-melt adhesive as the outsole cement or as part of the outsole cement, which not only cements on the outsole but also leads to waterproofness, prevents water which reaches the upper end region via water-conducting outer material of the upper from getting onto the inner side of the functional layer facing away from the outer material and consequently into the space inside the shoe. This risk is particularly great if there is a highly absorbent lining material on the inner side of the functional layer. In the case of footwear with cement-lasting, the reactive hot-melt adhesive used according to the invention as the outsole cement seals the lasting allowance, including the particularly critical lasting folds, reliably and permanently with a waterproof effect even after flexural stress during walking with the footwear.

In the case of footwear with cement-lasting, there is also the possibility of using reactive hot-melt adhesive both as the lasting cement and as the outsole cement. In this case, such reactive hot-melt adhesive is initially applied as lasting cement before the lasting operation and such reactive hot-melt adhesive is applied as outsole cement to the outsole after the lasting operation in order in this way to cement the outsole. The reactive hot-melt adhesive serving as lasting cement and the reactive hot-melt adhesive serving as outsole cement may be applied in such a way that they bond to form a cement surround which encloses or surrounds the end region on the sole side both of the outer material of the upper and of the functional layer of the upper in a waterproof way. This brings about particularly good sealing.

Whether a shoe is waterproof can be tested, for example, with a centrifuge arrangement of the type described in U.S. Pat. No. 5,329,807.

For the production of footwear according to the invention with cement-lasting, no further process steps are required than are needed for the conventional cement-lasting process for shoes with a cemented-on outsole. Thus, as already mentioned, no additional process steps are required to obtain waterproof shoes than are required in the case of shoes which are produced according to the documents mentioned at the beginning, apart from that reactive hot-melt adhesive is at least partially used as outsole cement and is applied to the outsole. This means that neither an injection mould nor an additional machine for introducing sealing material, nor an additional sealing adhesive bond between the peripheral border of the insole and the functional layer, nor a process step in which the free end of the lasting allowance must be encapsulated by means of a sealing material before the lasting operation can be performed are necessary in the case of the production method according to the invention.

The method according to the invention therefore leads to low production costs for waterproof shoes not achieved by the known methods.

The production of shoes according to the invention is made particularly simple and cost-effective by using reactive hot-melt adhesive which can be thermally activated and can be induced to undergo its curing reaction by means of moisture, for example water vapour.

The already mentioned expanding reactive hot-melt adhesive may be used if use is to be made of its increased volume, which makes it particularly suitable for filling cavities and penetrating into cracks or niches and thereby bringing about particularly reliable waterproofness.

When using a reactive hot-melt adhesive of inadequate initial strength owing to an over-long physical setting time, thermoplastic components which have an adequately short setting time and initially assume an adhesive bonding function until the reactive hot-melt adhesive has cured to such an extent that it sufficiently develops an adhesive action may be added to the reactive hot-melt adhesive.

Thermoplastics are materials which become adhesive by heating and cure by subsequent cooling. They can be brought back into an adhesive state by renewed heating. Thermoplastics are to be understood to be non-reactive polymers which can be added to reactive hot-melt adhesives.

Reactive hot-melt adhesives refer to adhesives which, before their activation, consist of relatively short molecule chains with an average molecular weight in the range from 3000 to 5000 g/mol, are non-adhesive and, after activating, possibly by heat, are brought into a state of reaction in which the relatively short molecule chains are crosslinked to form long molecule chains and thereby cure, doing so in moist atmosphere. During the reaction or curing time, they are adhesive. After the crosslinking curing, they cannot be re-activated. Full reaction leads to a three-dimensional crosslinking of the molecule chains, which makes the cured reactive hot-melt adhesive waterproof and leads to highly effective sealing. The three-dimensional crosslinking leads to particularly strong protection against penetration of water into the adhesive. This highly effective sealing and protection against the penetration of water are of great significance specifically in the region of the sole construction.

Suitable for the purpose according to the invention are, for example, polyurethane reactive hot-melt adhesives, resins, aromatic hydrocarbon resins, aliphatic hydrocarbon resins and condensation resins, for example in the form of epoxy resin (EP).

Particularly preferred are polyurethane reactive hot-melt adhesives, referred to hereafter as PU reactive hot-melt adhesives. Suitable as thermoplastics which can be added to the PU reactive hot-melt adhesive are, for example, thermoplastic polyesters and thermoplastic polyurethanes.

The crosslinking reaction bringing about the curing of PU reactive hot-melt adhesive is usually brought about by moisture, for which atmospheric moisture is adequate. There are blocked PU reactive hot-melt adhesives of which the crosslinking reaction can only begin after activation of the PU reactive hot-melt adhesive by means of thermal energy, so that such hot-melt adhesive can be stored in the open, i.e. surrounded by atmospheric moisture. On the other hand, there are non-blocked PU reactive hot-melt adhesives, in which a crosslinking reaction takes place at room temperature if they are surrounded by atmospheric moisture. The latter hot-melt adhesives must be kept in such a way that they are protected from atmospheric moisture as long as the crosslinking reaction is not yet to take place.

In the unreacted state, both types of PU reactive hot-melt adhesives are usually in the form of rigid blocks. Before applying to the regions to be cemented, the hot-melt adhesive is heated in order to melt it and consequently make it able to be spread or applied. If non-blocked hot-melt adhesive is used, such heating must be performed with the exclusion of atmospheric moisture. If blocked hot-melt adhesive is used, this is not necessary, but it must be ensured that the heating temperature remains below the deblocking activation temperature.

In one embodiment of the invention, PU reactive hot-melt adhesive which is constructed with blocked or capped isocyanate is used. To overcome the isocyanate blocking and consequently to activate the reactive hot-melt adhesive constructed with the blocked isocyanate, a thermal activation must be carried out. Activation temperatures for such PU reactive hot-melt adhesives lie approximately in the range from 70° C. to 170° C.

In another embodiment of the invention, non-blocked PU reactive hot-melt adhesive is used. The crosslinking reaction can be accelerated by supplying heat.

In a practical embodiment of the method according to the invention, a PU reactive hot-melt adhesive as can be obtained under the name IPATHERM S 14/242 from the company H.P. Fuller of Wels, Austria is used. In another embodiment of the invention, a PU reactive hot-melt adhesive which can be obtained under the name Macroplast QR 6202 from the company Henkel AG, Dusseldorf, Germany, is used.

Particularly preferred is a functional layer of the upper which is not only water-impermeable but also water-vapour permeable. This makes possible the production of waterproof shoes which remain breathable in spite of being waterproof.

A functional layer is regarded as "waterproof", if appropriate including the seams provided at the functional layer, if it ensures a water ingress pressure of at least 0.13 bar. The material of the functional layer preferably ensures a water ingress pressure of over 1 bar. The water ingress pressure must be measured here by a test method in which distilled water at 20±2° C. is applied with increasing pressure to a sample of the functional layer of 100 $cm^2$. The pressure increase of the water is 60±3 cm of water column per minute. The water ingress pressure then corresponds to the pressure at which water appears for the first time on the other side of the sample. Details of the procedure are described in ISO standard 0811 from the year 1981.

A functional layer is regarded as "water-vapour permeable" if it has a water-vapour permeability coefficient Ret of less than 150 $m^2.Pa.W^{-1}$. The water vapour permeability is tested by the Hohenstein skin model. This test method is described in DIN EN 31092 (02/94) or ISO 11092 (19/33).

The waterproofness of a shoe or boot can be tested by the already mentioned centrifuge method according to U.S. Pat. No. 5,329,807. A centrifuge arrangement described there has four swing-mounted holding baskets for holding footwear. With this arrangement, two or four shoes or boots can be tested at the same time. In this centrifuge arrangement, centrifugal forces generated by centrifuging the footwear at high speed are used for locating leaks in the footwear. Before centrifuging, the space inside the footwear is filled with water. Absorbent material, such as blotting paper or a paper towel for example, is arranged on the outer side of the footwear. The centrifugal forces exert a pressure on the water with which the footwear is filled, with the effect that water reaches the absorbent material if the footwear has a leak.

In such a waterproofness test, the footwear is first of all filled with water. In the case of footwear with outer material which does not have adequate inherent rigidity, rigid material is arranged in the space inside the upper for stabilizing it, in order to prevent the upper from collapsing during centrifuging. In the respective holding basket there is blotting paper or a paper towel, onto which the footwear to be tested is placed. The centrifuge is then made to rotate for a specific period of time. Thereafter, the centrifuge is stopped and the blotting paper or paper towel is examined to ascertain whether it is moist. If it is moist, the footwear tested has not passed the waterproofness test. If it is dry, the footwear tested has passed the test and is classified as waterproof.

The pressure which the water exerts during centrifuging depends on the effective shoe surface area (sole inner surface area) A, dependent on the shoe size, on the mass m of the amount of water with which the footwear is filled, on the effective centrifuging radius r and on the centrifuging speed U.

The water pressure exerted on the effective shoe surface area by the centrifuging is then:

$$P=(m\cdot v^2)/A\cdot r)=(m\cdot\omega^2\cdot r)/A$$

where $\omega=2\pi f$ and $v=2r\pi f$.

In a waterproofness test suitable for footwear according to the invention, an effective centrifuging radius of 50 cm and a centrifuging speed of 254 revolutions per minute are used. In the case of footwear of shoe size 42 with an effective shoe surface area of 232 $cm^2$, the footwear is filled with a liter of water.

This gives:

$m=1$ kg $v=2\cdot 0.5\ m\cdot\pi\cdot 4.23/s=13.3$ m/s $p=(1\ kg\cdot(13.3\ m/s)^2)/(0.5\ m\cdot 0.0232\ m^2)=353.8\ N/0.0232\ m^2=0.13956$ bar For other shoes sizes with correspondingly different effective shoe surface areas, an equal test pressure can be achieved with a correspondingly modified mass of water.

Leather or textile fabrics are suitable for example as the outer material for the upper. The textile fabrics may be, for example, woven, knitted or nonwoven fabrics or felt. These textile fabrics may be produced from natural fibres, for example from cotton or viscose, from man-made fibres, for example from polyesters, polyamides, polypropylenes or polyolefins, or from blends of at least two such materials.

The insole of footwear according to the invention may consist of viscose, a nonwoven, for example polyester nonwoven, to which fusible fibres may be added, leather or adhesively bonded leather fibres. An insole can be obtained under the name Texon Brandsohle from Texon Mockmuhl GmbH of Mockmuhl, Germany.

A lining material is normally arranged on the inner side of the outer material for the upper. Suitable for this are the same materials as specified above for the outer material.

The sealing according to the invention provides that an outsole is applied to the underside of the shoe. This outsole may consist of waterproof material, such as for example rubber or plastic, for example polyurethane, or of non-waterproof material, such as leather in particular.

The adhesive bonding of the reactive hot-melt adhesive with the underside of the shoe becomes particularly intimate if, after being applied to the underside of the shoe, the reactive hot-melt adhesive is mechanically pressed against the underside of the shoe and consequently compressed. Preferably suitable for this purpose is a pressing device, for example in the form of a pressing pad, with a smooth material surface which cannot be wetted by the reactive hot-melt adhesive and therefore cannot bond with the reactive hot-melt adhesive, for example of non-porous polytetrafluoroethylene (also known by the trade name Teflon). Preferably used for this purpose is a pressing pad, for example in the form of a rubber pad or air cushion, the pressing surface of which is covered with a film of the said material, for example non-porous polytetrafluoroethylene, or such a film is arranged between the sole construction provided with the reactive hot-melt adhesive and the pressing pad before the pressing operation.

Suitable materials for the waterproof, water-vapour permeable functional layer are, in particular, polyurethane, polypropylene and polyester, including polyether esters and their laminates, such as are described in the documents U.S. Pat. Nos. 4,725,418 and 4,493,870. Particularly preferred, however, is stretched microporous polytetrafluoroethylene (ePTFE), as is described for example in the documents U.S. Pat. Nos. 3,953,566 and 4,187,390, and stretched polytetrafluoroethylene provided with hydrophilic impregnating agents and/or hydrophilic layers; see, for example, the document U.S. Pat. No. 4,194,041. A microporous functional layer is understood to be a functional layer of which the average pore size lies between approximately 0.2 $\mu$m and approximately 0.3 $\mu$m.

The pore size can be measured with the Coulter Porometer (trade name), which is produced by Coulter Electronics, Inc., Hialeath, Fla., USA.

The Coulter Porometer is a measuring instrument which provides an automatic measurement of the pore size distributions in porous media, using the liquid displacement method (described in ASTM Standard E 1298-89).

The Coulter Porometer determines the pore size distribution of a sample by means of an increasing air pressure directed at the sample and by measuring the resultant flow. This pore size distribution is a measure of the degree of uniformity of the pores of the sample (i.e. a narrow pore size distribution means that there is little difference between the smallest pore size and the largest pore size). It is determined by dividing the maximum pore size by the minimum pore size.

The Coulter Porometer also calculates the pore size for the average flow. By definition, half the flow takes place through the porous sample through pores of which the pore size lies above or below this pore size for average flow.

If ePTFE is used as the functional layer, the reactive hot-melt adhesive can penetrate into the pores of this functional layer during the cementing operation, which leads to a mechanical anchoring of the reactive hot-melt adhesive in this functional layer. The functional layer consisting of ePTFE may be provided with a thin polyurethane layer on the side with which it comes into contact with the reactive hot-melt adhesive during the cementing operation. If PU reactive hot-melt adhesive is used in conjunction with such a functional layer, there occurs not only the mechanical bond but also a chemical bond between the PU reactive hot-melt adhesive and the PU layer on the functional layer. This leads to a particularly intimate adhesive bonding between the functional layer and the reactive hot-melt adhesive, so that particularly durable waterproofness is ensured.

To achieve waterproofness in the sole region as well, a waterproof outsole and/or a waterproof insole may be used. Waterproofness in the sole region can also been ensured, however, by providing the water-permeable regions of the insole and/or outsole with a waterproof, water-vapour permeable sole functional layer, or by applying to the entire outsole reactive hot-melt adhesive which brings about waterproofness after reacting and consequently makes the entire outsole waterproof.

A shoe according to the invention may be constructed with an upper of outer material and a functional layer of the upper, lining the upper of outer material on its inner side, the said functional layer preferably being part of a laminate which has the functional layer and at least one lining layer facing the inner side of the shoe. The laminate may also have more than two layers, it being possible for there to be a textile backing on the side of the functional layer remote from the lining layer. In this case, a lasting allowance can be formed both for the upper comprising the outer material and for the upper comprising the functional layer. In this case, the cement-lasting of the two lasting allowances can be accomplished in a single cement-lasting operation or in two separate cement-lasting operations.

In another embodiment of the invention, a multi-layer laminate which comprises both outer material and a functional layer is used. An upper constructed in this way then need only be lined on the inner side with a simple lining material.

Footwear according to a further embodiment comprises a sole construction with an insole, a gauze strip being arranged between the insole and the upper end region, a first side edge of the said gauze strip being joined to the insole and a second side edge being joined both to the outer-material end region and to the functional-layer end region.

In the case of this footwear too, the outsole may be provided at least partially with reactive hot-melt adhesive, in order to seal a functional layer in the sole region against water. In this case, the outsole cement is formed by a reactive hot-melt adhesive at least in a subregion of the outsole which is closed in the direction of the sole periphery and lies opposite the gauze strip.

Footwear of this type represents an independent invention, however, irrespective of whether an outsole provided with reactive hot-melt adhesive is used or not. If an outsole not provided with reactive hot-melt adhesive is used for this shoe construction, sealing of the functional-layer end region can be achieved in another way.

One possibility is to mould on an outsole, the outsole material that is liquid during the moulding-on forcing its way through the gauze strip and penetrating as far as the inner side of the functional-layer end region, where it can seal the functional layer. If the gauze strip is sewn to the upper end region, in this way the seam passing through the functional-layer end region can also be sealed by means of outsole material.

Particularly whenever a cemented-on outsole is desired, but not the solution with reactive hot-melt adhesive, waterproofness of the functional layer in the functional-layer end region can be achieved in this embodiment with a gauze strip by introducing another sealing material through the gauze strip, for example by means of the method known from the already mentioned EP 0 286 854 A.

BRIEF DESCRIPTION OF THE DRAWINGS

The invention is now explained in more detail on the basis of exemplary embodiments. In the drawings, in schematized representation.

DETAILED DESCRIPTION OF PREFERRED EMBODIMENTS OF THE INVENTION

Figure 1:
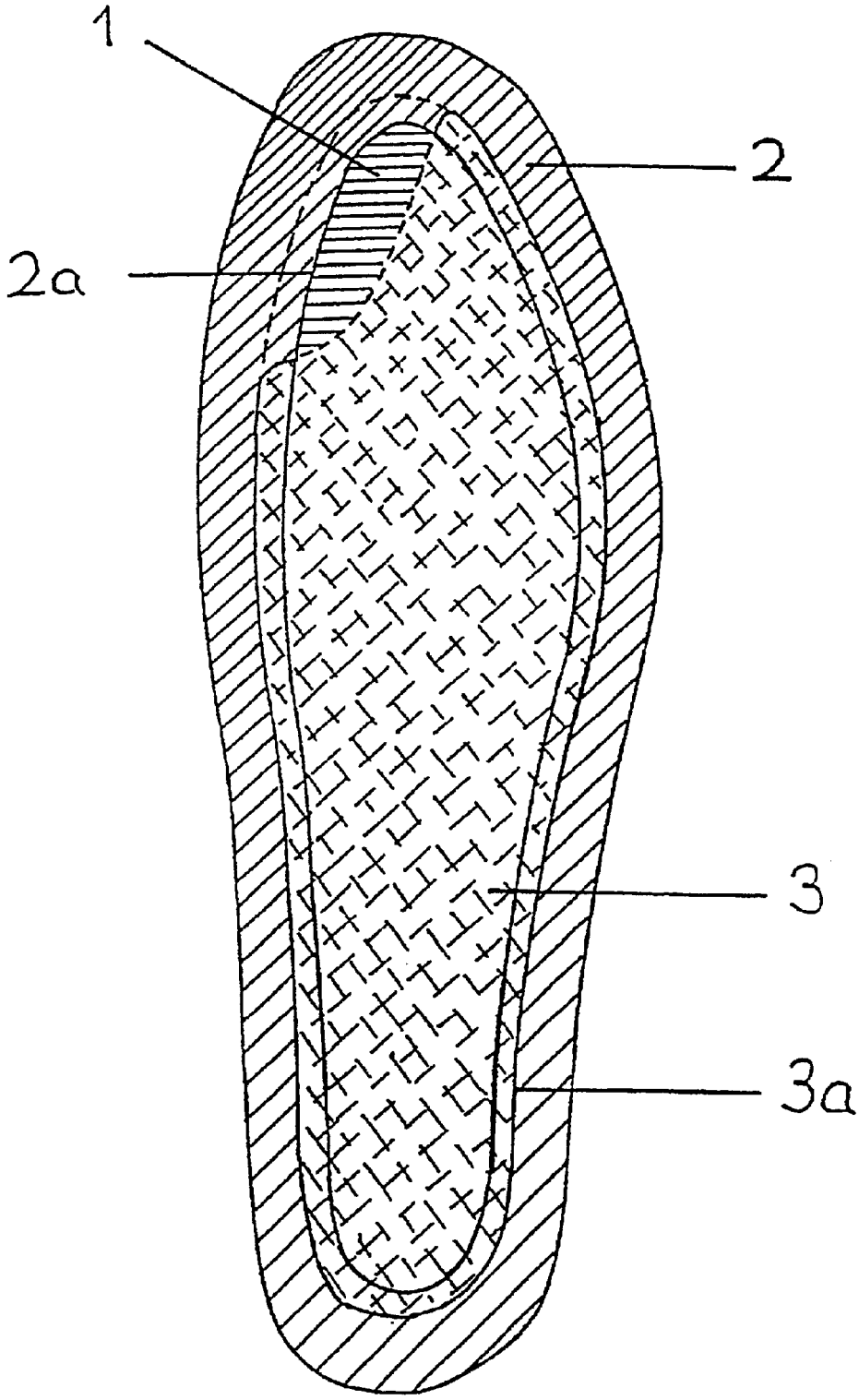
FIG. 1 shows a bottom view of a first embodiment of a shoe according to the invention without an outsole.

The shoe of the first embodiment of the invention, shown in FIG. 1, has an insole 1, an upper with a lasting allowance 2, joined to the insole 1 by means of cement-lasting, and reactive hot-melt adhesive 3 applied to the underside of the insole 1 and lasting allowance 2. In this case, the reactive hot-melt adhesive 3 covers the entire region of the underside of the insole that is not covered by the lasting allowance 2 and a subregion of the lasting allowance 2 adjacent to this region of the insole 1. In a preferred embodiment, there is an overlap 3*a* of the reactive hot-melt adhesive 3 over the lasting allowance 2 over a width of about 1 cm.

A shoe of this type is preferably produced as follows:

The insole 1 is initially attached to the underside of a last (not represented). An upper is then stretched over the last, the peripheral border of the underside of the insole is provided with conventional lasting cement and the lasting allowance 2 is pulled onto the underside of the insole and cemented to it. After that, the reactive hot-melt adhesive 3 is applied to the undersides of the insole 1 and lasting allowance 2 and pressed there, in order to obtain an underside of the shoe with a flat and uniform surface.

Figure 2:
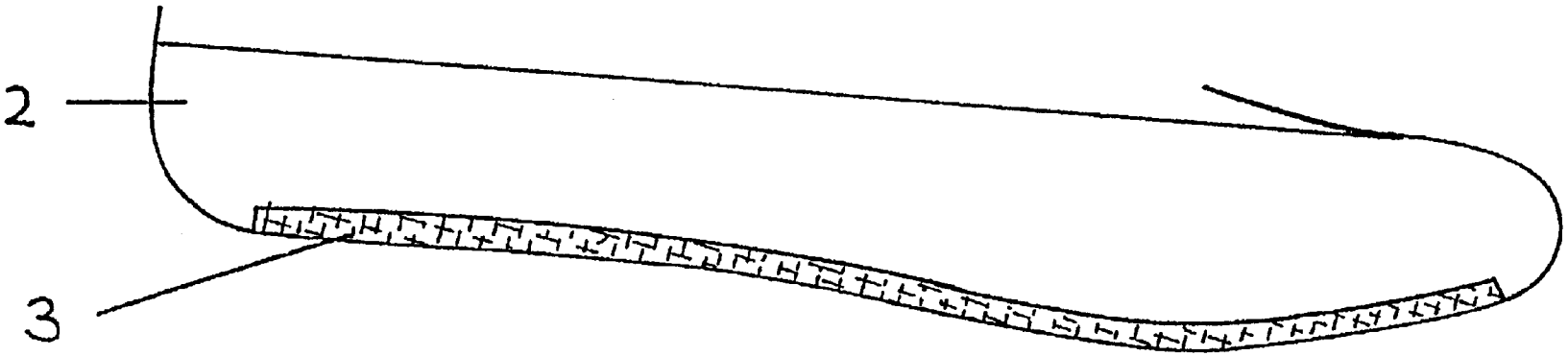
FIG. 2 shows a side view of the sole region of the shoe shown in FIG. 1.

This state of production is represented in side view in FIG. 2.

An outsole (not represented) is then applied, for example by adhesive bonding, to the underside of the sole provided with the reactive hot-melt adhesive 3.

The underside of the shoe or the sole structure is made waterproof with the aid of the reactive hot-melt adhesive 3.

Figure 3:
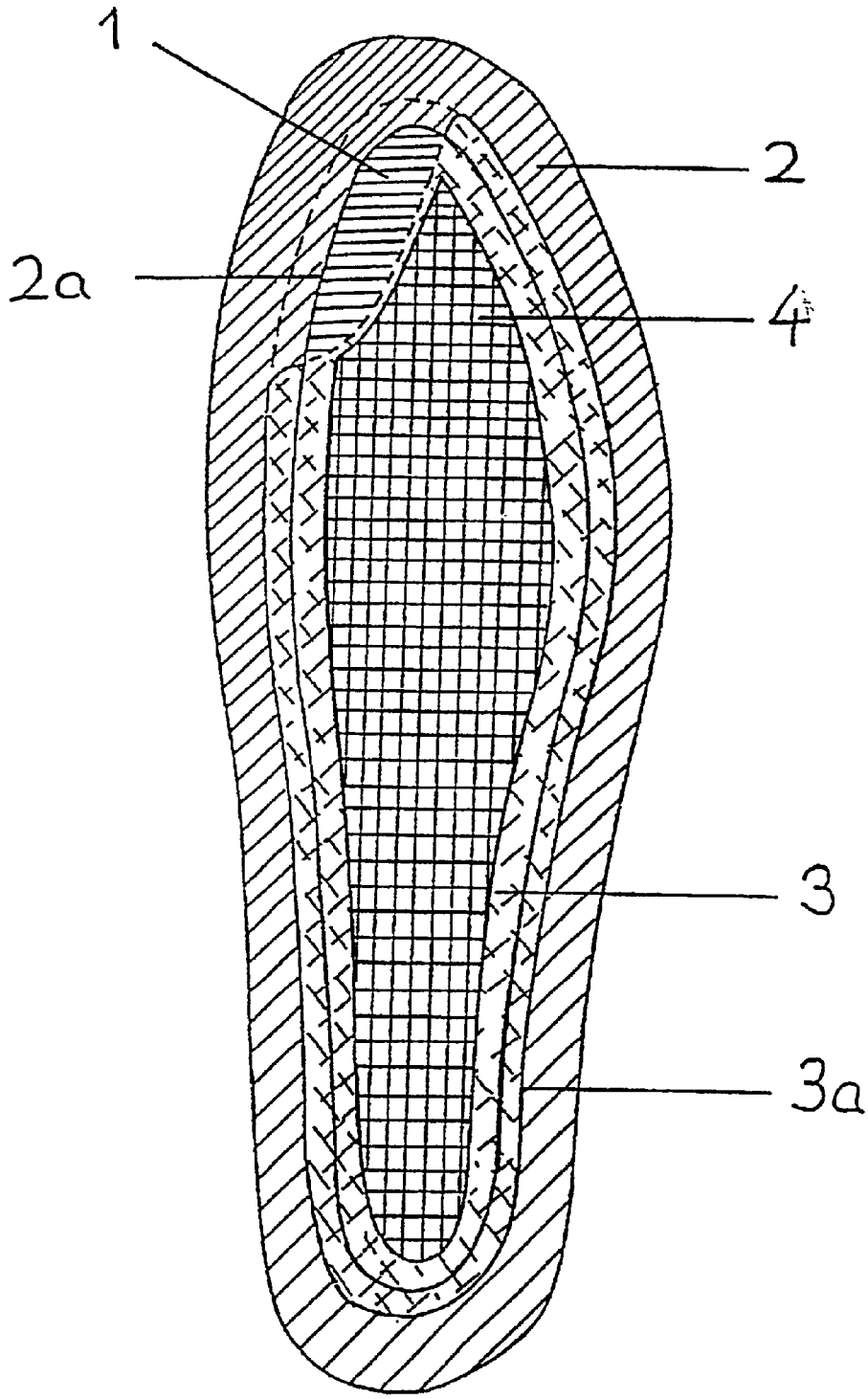
FIG. 3 shows a bottom view of a second embodiment of a shoe according to the invention without an outsole.

The second embodiment of the invention, shown in FIG. 3, shows a shoe which coincides with the shoe represented in FIGS. 1 and 2, except that it is provided on the lower surface facing away from the insole 1 with an open-pore, adhesive-compatible material 4, which is cemented flush in the reactive hot-melt adhesive 3. By applying this material 4, the waiting times are reduced and immediate further processing of the shoe produced to this extent is made possible.

Figure 4:
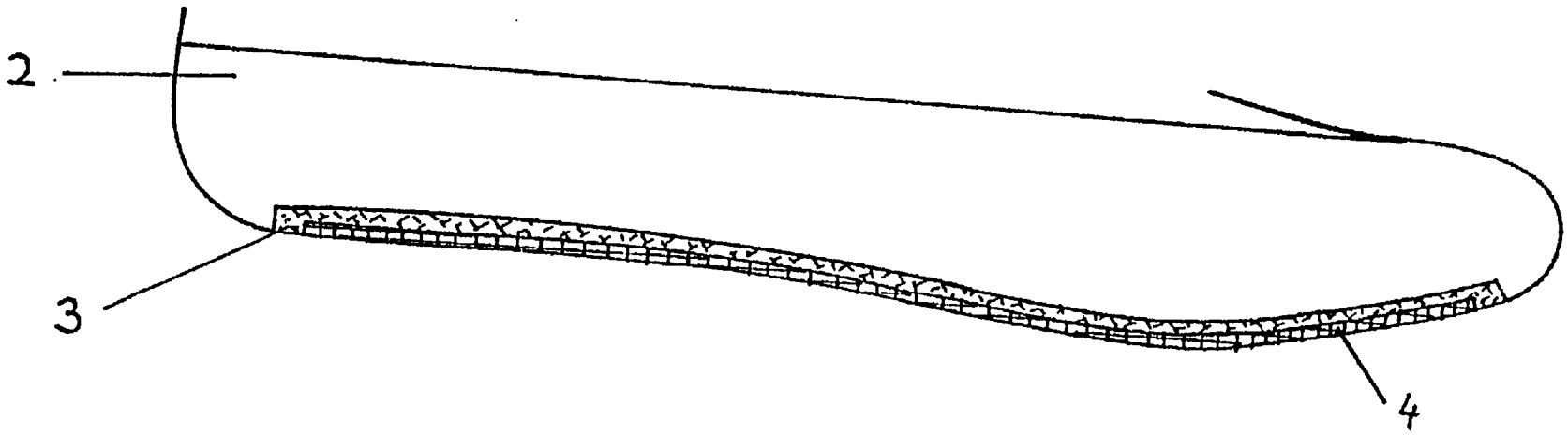
FIG. 4 shows a side view of the sole region of the shoe shown in FIG. 1.

A side view of this shoe of the second embodiment corresponding to FIG. 2 is shown in FIG. 4, the flush cementing of the material 4 with the reactive hot-melt adhesive 3 being readily apparent.

The reactive hot-melt adhesive 3 is preferably applied as a viscous adhesive, it being possible for the degree of fluidity to be influenced by the intensity of the heating of the reactive hot-melt adhesive 3.

Figure 5:
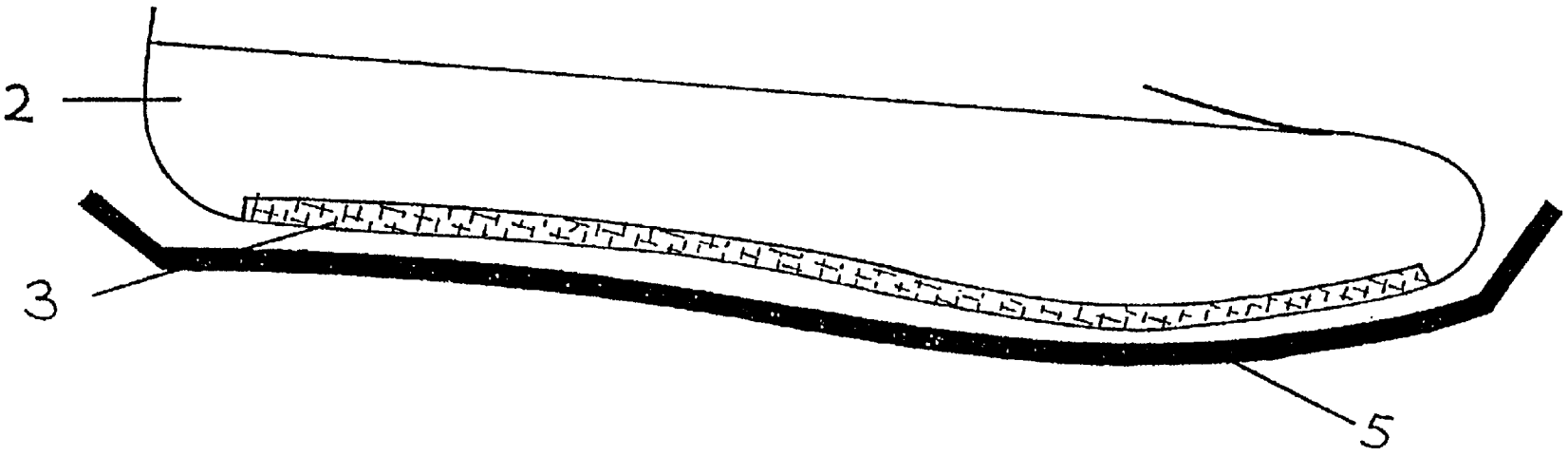
FIG. 5 shows the side view as in FIG. 2, but with additional schematized representation of a pressing device for pressing reactive hot-melt adhesive.

A pressing device 5 for pressing the reactive hot-melt adhesive 3 onto the undersides of the insole 1 and lasting allowance 2 is shown in a very schematized way in FIG. 5. A pressing pad of the type already mentioned is particularly suitable for this purpose.

The invention is explained below on the basis of further exemplary embodiments which show shoes with various constructions of the sole, namely:

- shoes with cement-lasting;
- shoes with at least one seam for producing a connection between an upper end region and an insole; and
- shoes of which the upper end region is secured by means of string-lasting.

Also considered are, on the one hand, shoes in which the outer material and the functional layer belong to separate material layers, a functional-layer end region on the sole side having an overhang with respect to an outer-material end region on the sole side and, on the other hand, shoes which are constructed with a laminate which has both an outer material and a functional layer, and which therefore have no such overhang.

16 embodiments of shoes consecutively designated S1 to S16 are shown in FIGS. 6–27.

In the embodiments considered below, the same parts are marked by the same reference numerals, even if they belong to different embodiments S1 to S16 of the shoe.

Figure 6:
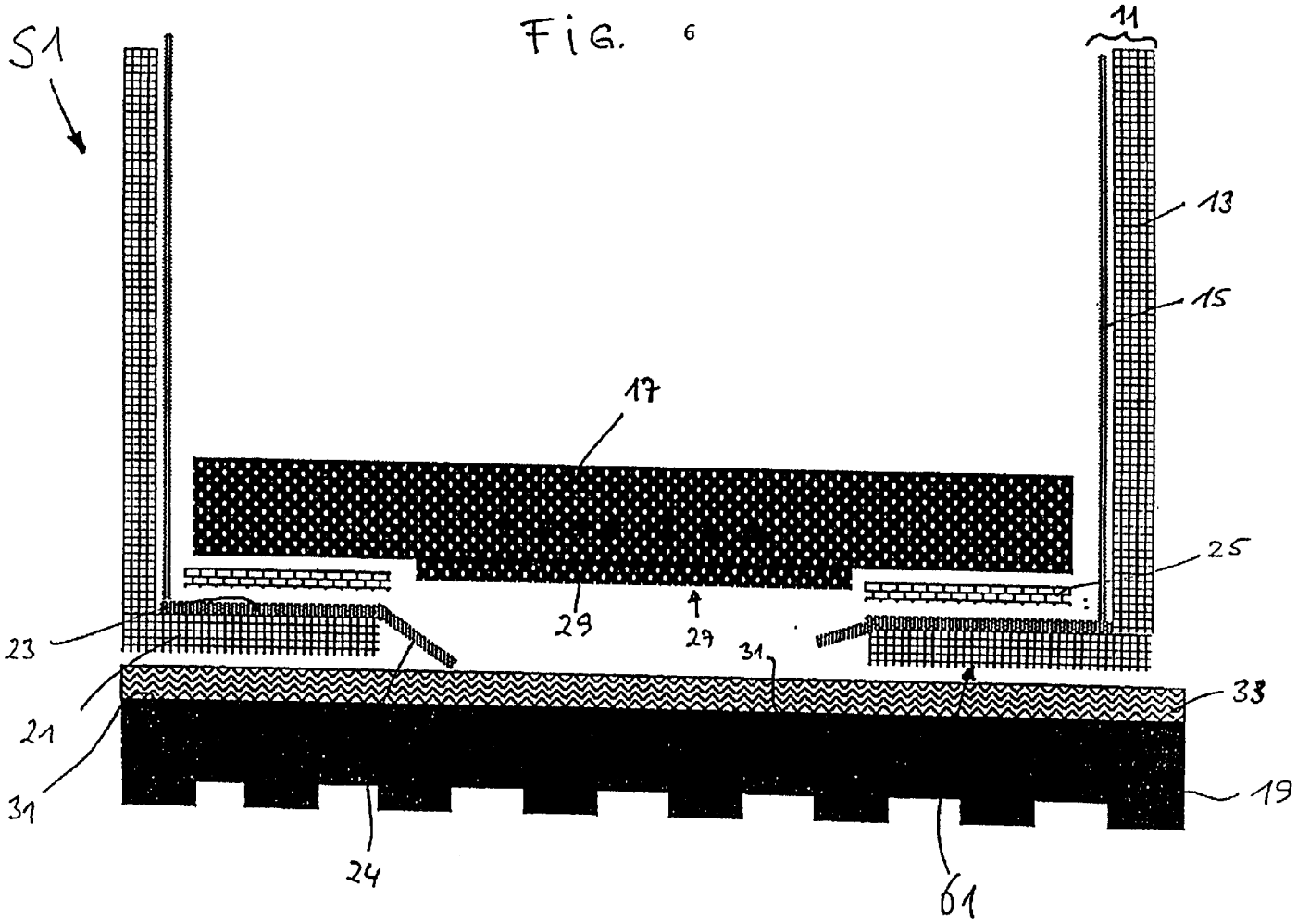
FIG. 6 shows a third embodiment of a shoe according to the invention with cement-lasting.

FIG. 6 shows a shoe S1 with an upper 11, which is constructed with an outer material 13 and a functional layer 15, lining the inner side of the said outer material. This shoe has an insole 17 and an outsole 19. The outer material 13 comprises an outer-material end region 21. The functional layer 15 has a functional-layer end region 23 with an overhang 24, projecting beyond the outer-material end region 21 in the direction of the middle of the shoe. The shoe S1 is a shoe with cement-lasting, that is to say the functional-layer end region 23 is fastened by means of a lasting cement 25 to a peripheral region of the insole underside 27. Towards the middle of the sole, the insole underside 27 is provided with a zone 29 of increased thickness 29. The outsole 19 is a prefabricated outsole, for example made of rubber or plastic, on the outsole top side 31 of which, facing the insole 17, there has been applied over the full surface area a reactive hot-melt adhesive 33, by means of which the outsole 19 is cemented to the insole underside 27, the underside of the outer-material end region 21 and the overhang 24. In the fully reacted state, the reactive hot-melt adhesive brings about waterproofness, so that the surface of the functional layer is cemented with a waterproof effect in the region of the overhang 24 by means of the reactive hot-melt adhesive 33. Therefore, water which penetrates via the outer material 13 to the end of the outer-material end region 21 facing the middle of the sole cannot creep along the underside of the overhang 24, around its cut edge and then to its top side. Since the functional layer 15 is generally part of a multi-layer laminate which is provided with a generally very absorbent lining layer on the inner side facing the interior of the shoe, water creeping along the outer material 13 would be able to penetrate to this inner lining layer without a sealing adhesive bonding of the overhang 24 by the reactive hot-melt adhesive 33. This would have the consequence that the space inside the shoe becomes wet. This is effectively prevented by the cementing of the overhang 24 by the reactive hot-melt adhesive 33.

Waterproofness is ensured with respect to the insole underside 27 of the shoe S1 represented in FIG. 6, irrespective of whether the outsole 19 consists of waterproof material or water-permeable material. This is so because, since the entire outsole top side 31 is provided with reactive hot-melt adhesive, the entire outsole is also sealed against water permeability. Therefore, no water can penetrate to the insole 17.

The reactive hot-melt adhesive of the shoe S1 is preferably expanded reactive hot-melt adhesive 33*a,* which increases to a greater volume than non-expanded reactive hot-melt adhesive during reacting to form hardened adhesive, and as a result can better fill the intermediate space between the outsole top side 31 and the insole underside 27. The foaming pressure generated during expansion also allows the reactive hot-melt adhesive to penetrate better into cracks and niches.

Figure 7:
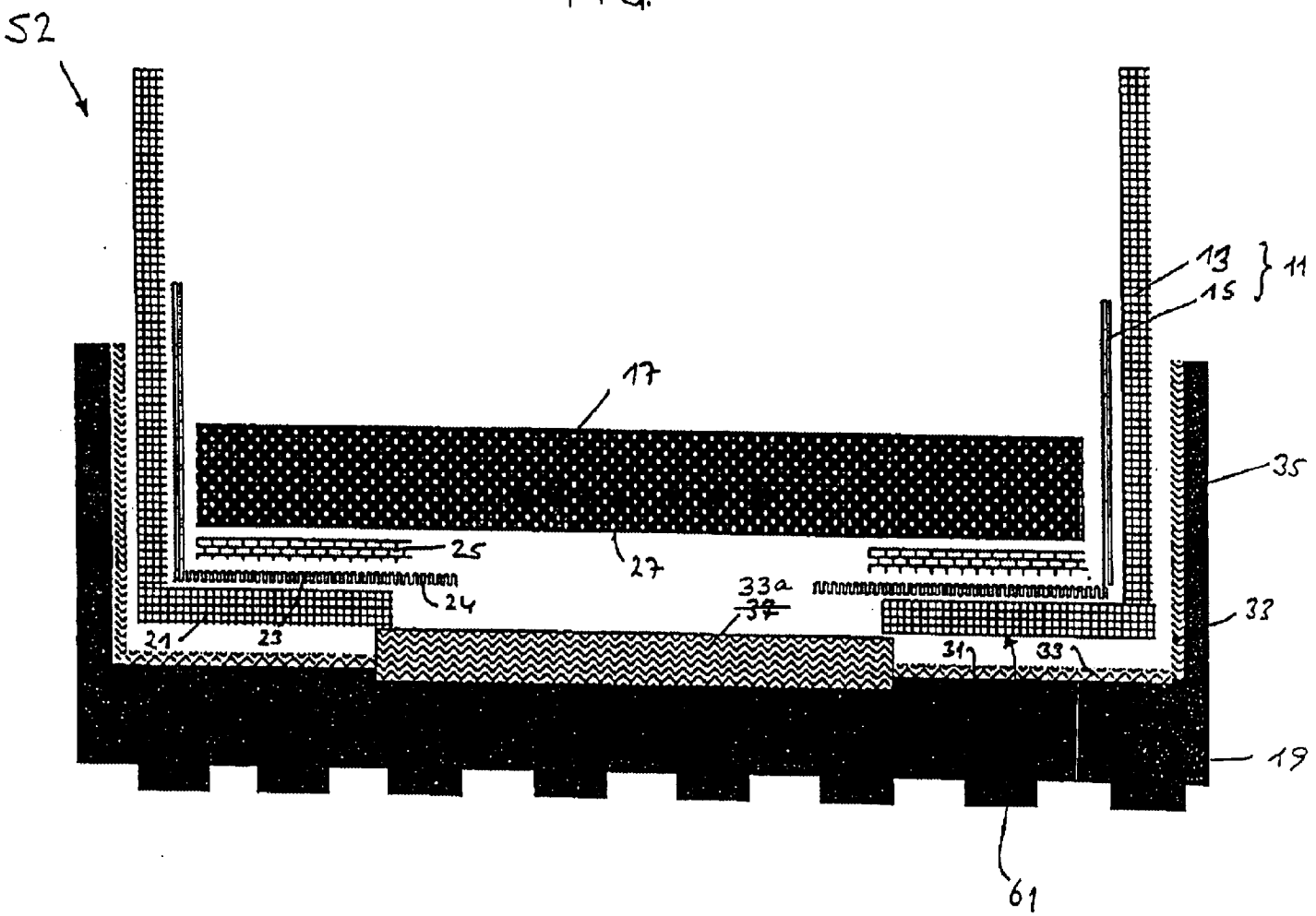
FIG. 7 shows a fourth embodiment of a shoe according to the invention with cement-lasting.

The shoe S2 shown in FIG. 7 has a similar construction to the shoe S1 shown in FIG. 6. A first difference is that an outsole 19 which is not flat but turned up at the edges is used. This has a turned-up border 35 which runs around the periphery of the outsole and encloses the lower part of the upper up to a height above the insole 17. Another difference in comparison with the shoe S1 is that only the part of the reactive hot-melt adhesive 33 in the region of the middle of the outsole takes the form of expanded reactive hot-melt adhesive 33*a*, while non-expanding reactive hot-melt adhesive 33 is applied to the border regions of the outsole top side 31 and the inner side of the turned-up border 35. That is to say that the expanded reactive hot-melt adhesive 33*a,* which achieves a larger volume and creeps better under the foaming pressure, is used in the regions in which a sealing of the functional layer is desired and the insole underside 27 is not covered with material of the upper end region, so that a kind of cavity is produced there, while non-expanding reactive hot-melt adhesive 33 is used in the other regions, in which the outsole top side 31 and the inner side of the turned-up border 35 lie opposite relatively smooth and planar regions of the upper, since an increase in volume of the reactive hot-melt adhesive is not required, and is possibly not desired, there.

In the embodiment shown in FIG. 7, the insole 17 is not shown with a zone of increased thickness. It goes without saying that this may be provided, as in the case of the shoe S1 in FIG. 6.

Figure 8:
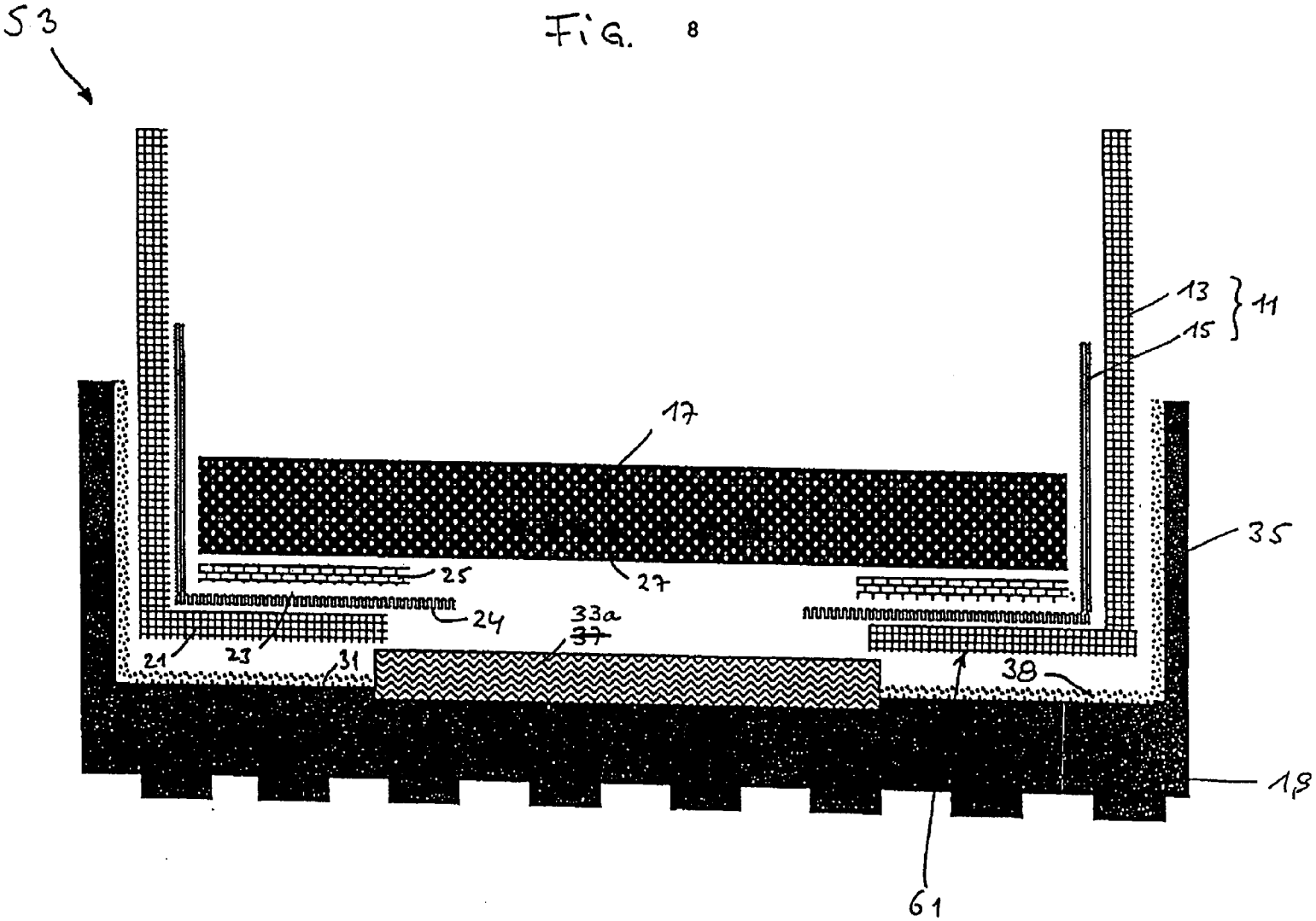
FIG. 8 shows a fifth embodiment of a shoe according to the invention with cement-lasting.

The shoe S3 shown in FIG. 8 coincides with the shoe S2 of FIG. 7, with the only exception that conventional solvent adhesive 38, as is used as the outsole cement in conventional shoe production processes, is applied to the outsole 19 outside its middle region 37 provided with reactive hot-melt adhesive 33 or 33*a*. Since a sealing of the functional-layer end region in the area of its overhang 24 is sufficient, it is not necessary likewise to apply sealing reactive hot-melt adhesive outside the middle region 37, provided with reactive hot-melt adhesive 33 or 33*a,* of the outsole 19.

Figure 9:
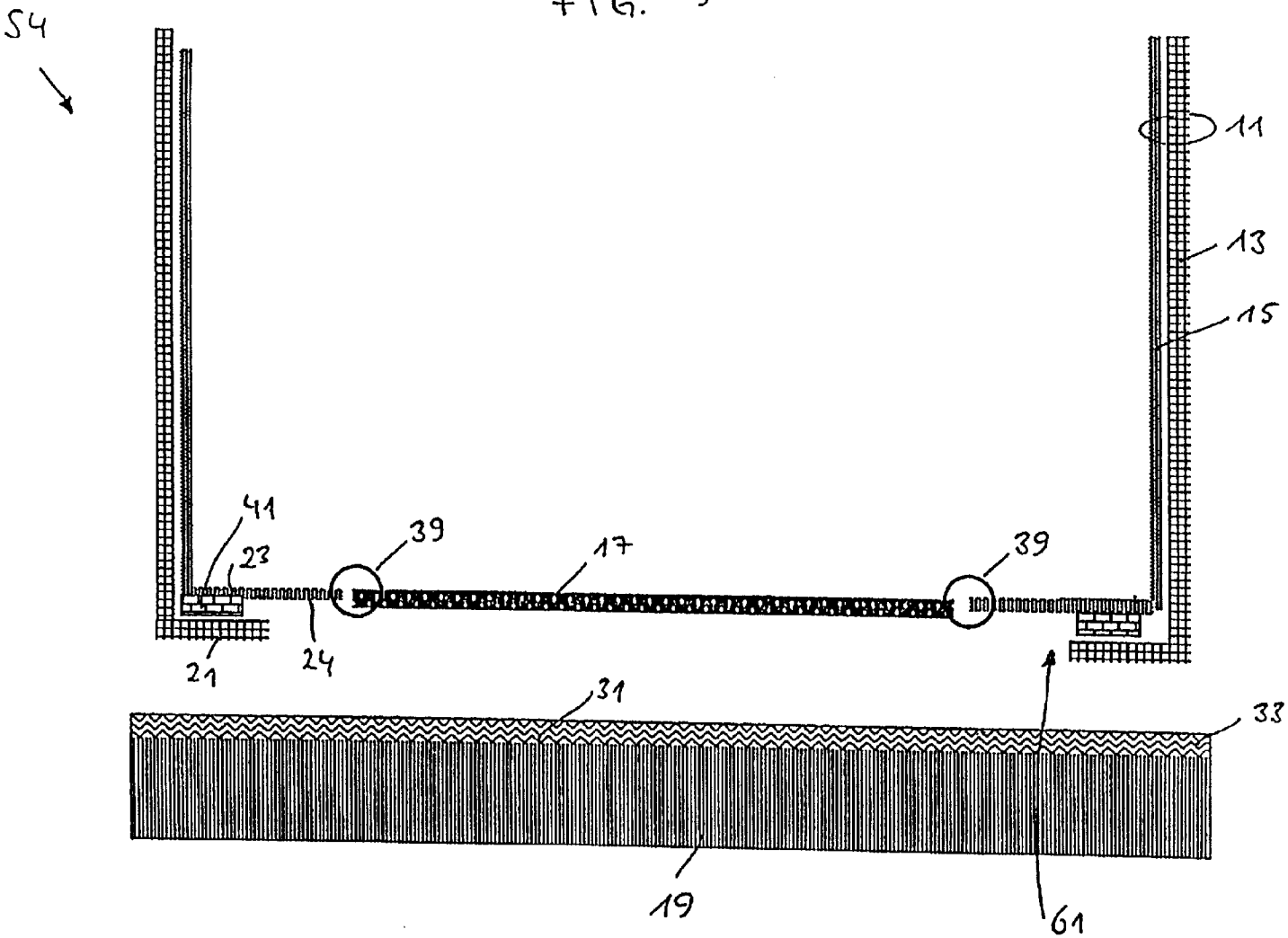
FIG. 9 shows a third embodiment of a shoe according to the invention with a Strobel seam between the functional layer and the insole.

FIG. 9 shows an example of a shoe with a sewn insole. The shoe S4 shown in FIG. 9, like the shoes S1 to S3, has an upper 11, which is provided with an outer material 13 and a functional layer 15, lining the outer material 13 on the inner side of the latter. In the case of the shoe S4 as well, the functional-layer end region 23 has an overhang 24 beyond the outer-material end region 21. As a difference from the shoes S1 to S4, however, the functional-layer end region 23 is not joined to the insole 17 by means of cement-lasting but by means of a seam 39, for example in the form of a Strobel seam. The outer-material end region 21 is fixed by means of a fixing adhesive 41 to the underside of the functional-layer end region 23 facing the outsole 19. The outsole 19 is provided over its full surface area with reactive hot-melt adhesive 33, which is preferably expanded reactive hot-melt adhesive. After the outsole 19 has been pressed onto the bottom end of the upper and onto the insole 17, the reactive hot-melt adhesive 33 on the one hand brings about a fastening of the outsole 19 to the upper 11 and the insole 17 and on the other hand brings about a sealing of the functional-layer end region 23 in the region of its overhang 24. In this case as well, water which creeps along the outer material 13 can therefore penetrate only as far as the cut end of the outer-material end region 21, but not up to the seam 39, and therefore also not up to the inner side of the functional layer 15 and to the inner lining usually provided there.

Figure 10:
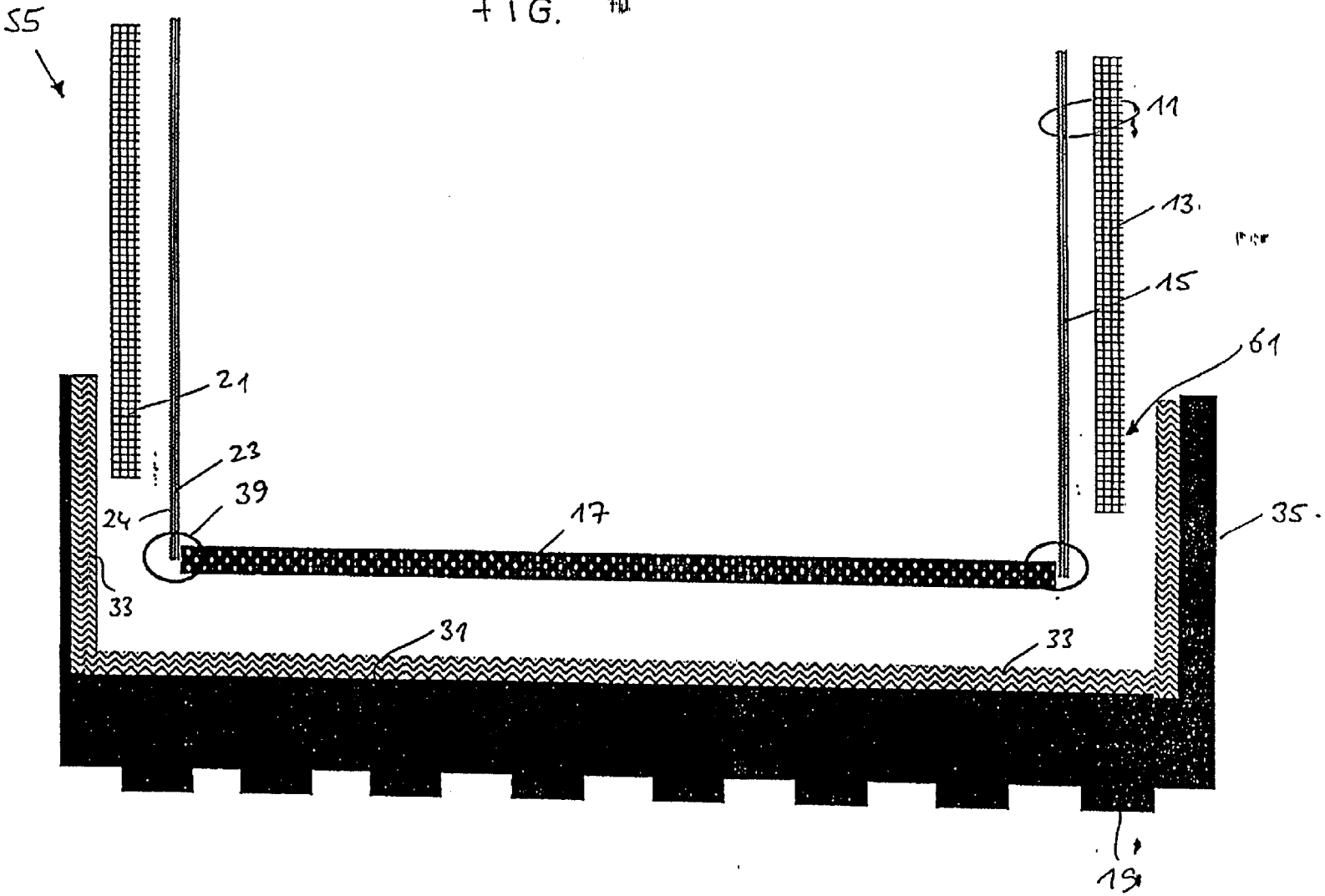
FIG. 10 shows a fourth embodiment of a shoe according to the invention with a Strobel seam between the functional layer and the insole.
Figure 11:
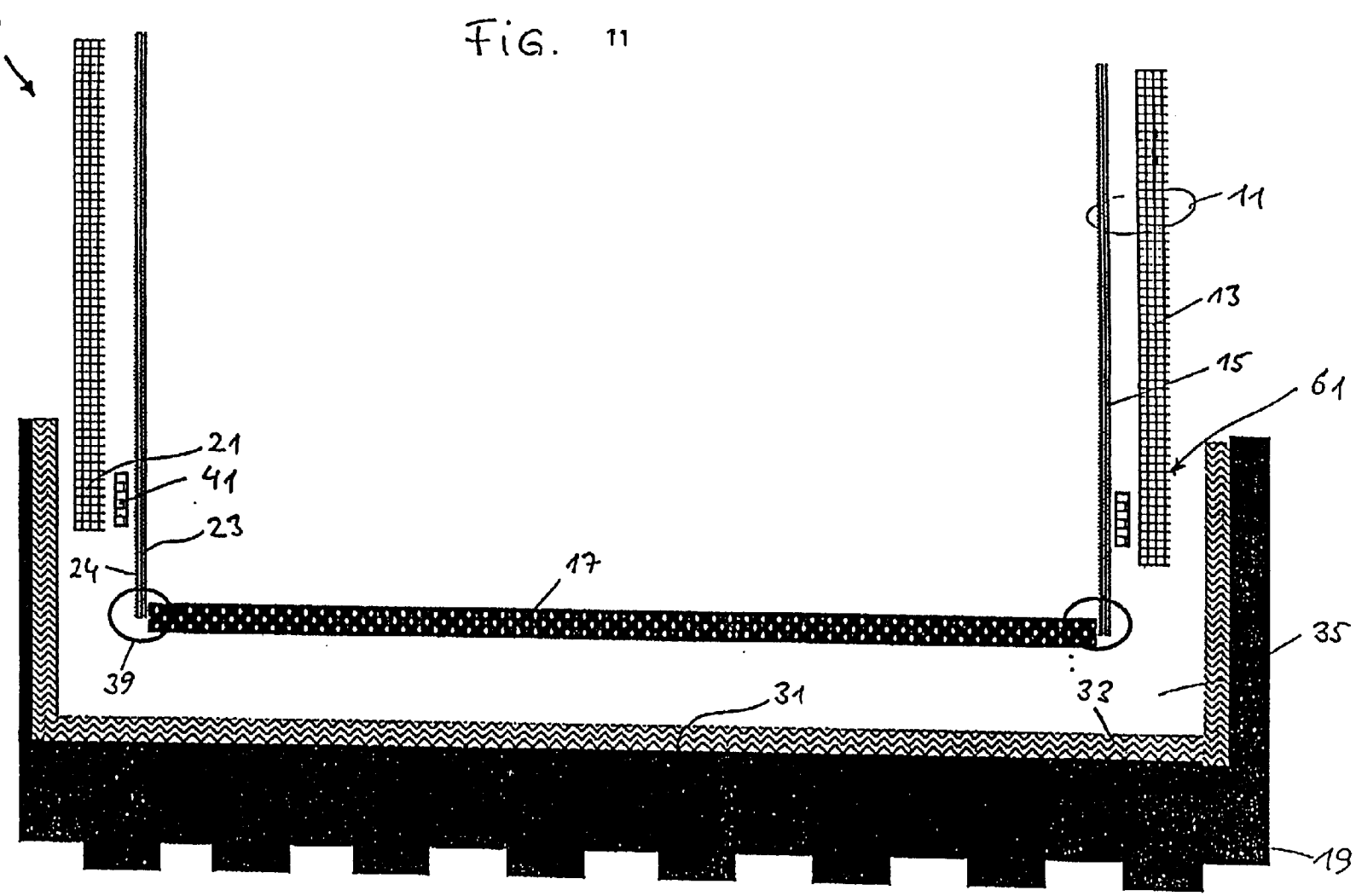
FIG. 11 shows a fifth embodiment of a shoe according to the invention with a Strobel seam between the functional layer and the insole.
Figure 12:
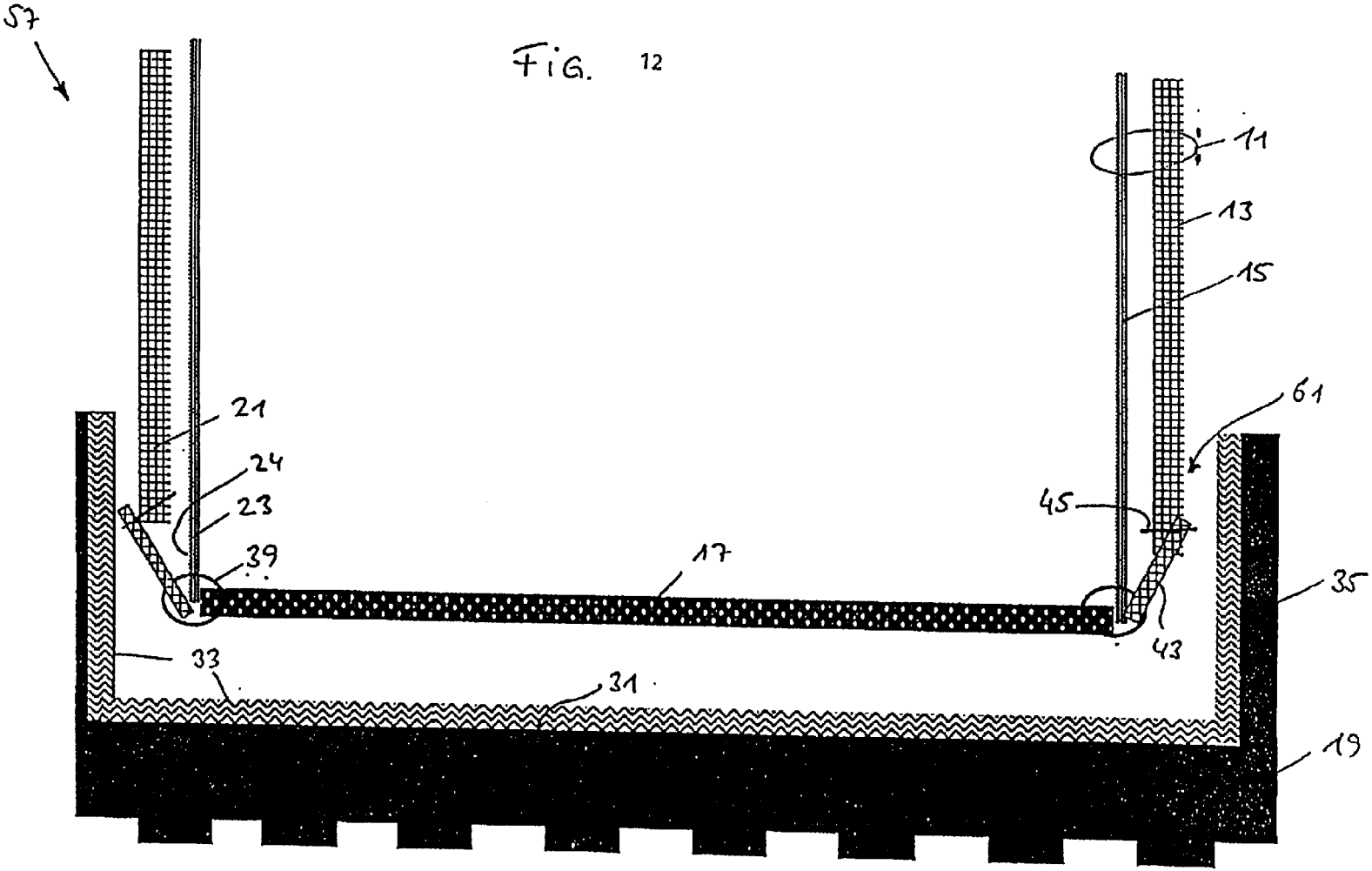
FIG. 12 shows a sixth embodiment of a shoe according to the invention with a Strobel seam between the functional layer and the insole.

While FIGS. 6–9 show shoe constructions in which the end region of the upper along with the outer-material end region 21 and the functional-layer end region 23 extend parallel to the tread of the outsole 19 and parallel to the insole 17 provided there, there are then shown in connection with the shoes S5 to S7 shown in FIGS. 10–12 embodiments of shoes in which the upper end region having the outer-material end region 21 and the functional-layer end region 23 extends perpendicular to the surface of the outsole and perpendicular to the insole. For this embodiment of a shoe, an insole with turned-up edges rising up beyond the bottom end of the outer-material end region is recommendable.

The shoes S5 to S7 are embodiments with a seam between the insole and the functional-layer end region.

In the shoe S5 shown in FIG. 10, the upper 11 has an outer material 13 with an outer-material end region 21. The seam 39 joining the functional-layer end region 23 to the insole 17 is again preferably a Strobel seam. In this embodiment, the entire outsole surface 31 and the entire inner side of the turned-up border 35 are provided with reactive hot-melt adhesive 33, so that there is sealing by means of reactive hot-melt adhesive in the entire outsole region.

The shoe S6 shown in FIG. 11 coincides with the shoe S5 shown in FIG. 10, with the exception that the outer-material end region 21 is fixed by means of fixing adhesive 41 to the outer side of the functional-layer end region 23. This facilitates the cementing-on of the outsole 19 with turned-up edges, because the prior fixing by means of the fixing adhesive 41 means that the outer-material end region 21 cannot slip when the outsole 19 is moved up against the insole 17.

The shoe S7 shown in FIG. 12 coincides with the shoe S6 shown in FIG. 11 with the exception that here the fixing of the outer-material end region 21 to the functional-layer end region 23 is brought about not by means of fixing adhesive 41 but by means of a gauze strip 43, which is permeable to the reactive hot-melt adhesive 33 still in liquid form in the non-reacted state. A top end of the gauze strip is fastened by means of a seam 45 to the outer-material end region 21, while a bottom side of the gauze strip 43 is fastened both to the insole 17 and to the bottom end of the functional-layer end region 23 by means of the Strobel seam 39.

The gauze strip 43 may be contructed with fibres of plastic, for example of polyamide or polyester. A gauze strip 43 of monofilament fibres is preferred.

Figure 13:
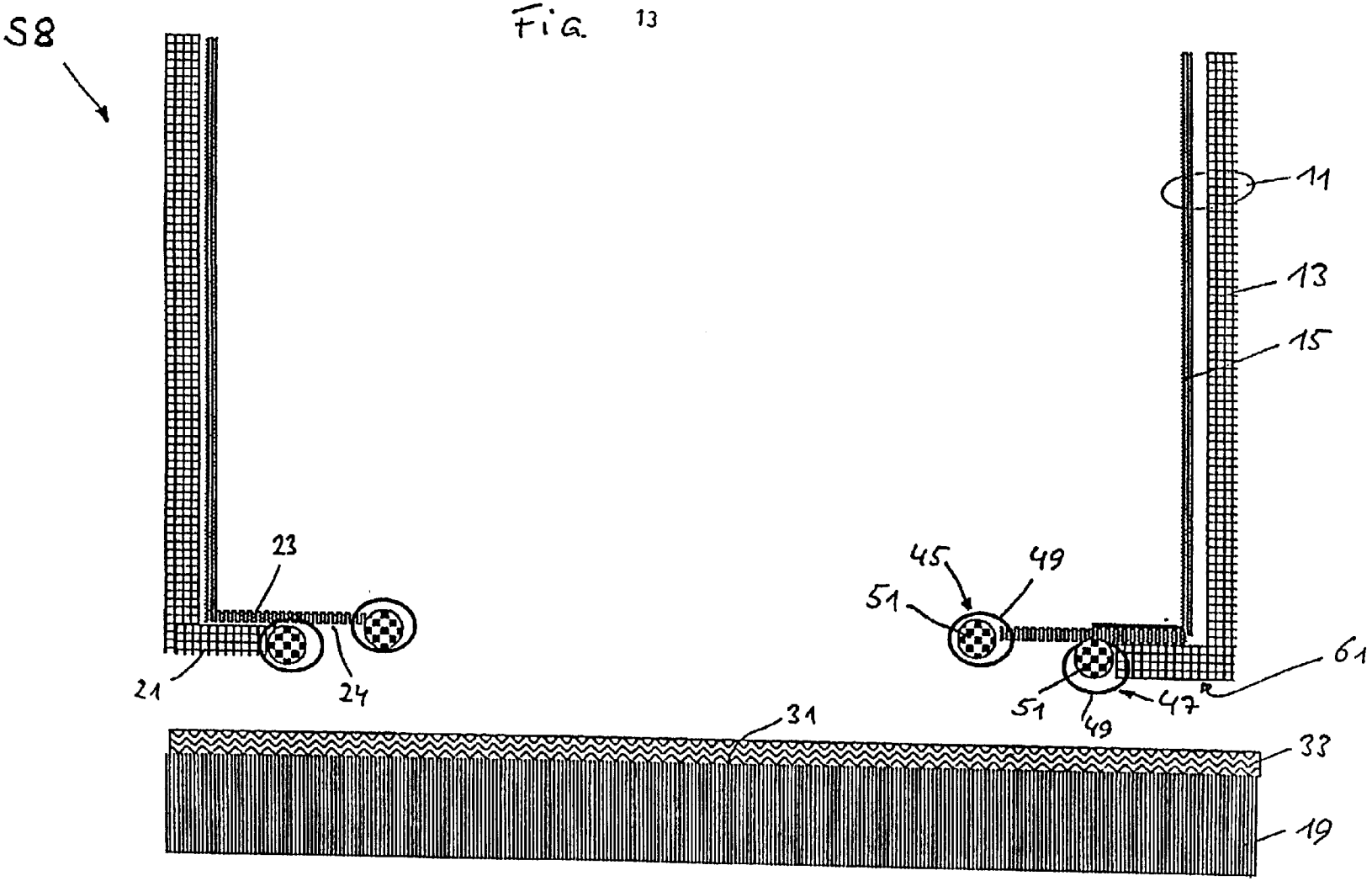
FIG. 13 shows a third embodiment of a shoe according to the invention with string-lasting.
Figure 14:
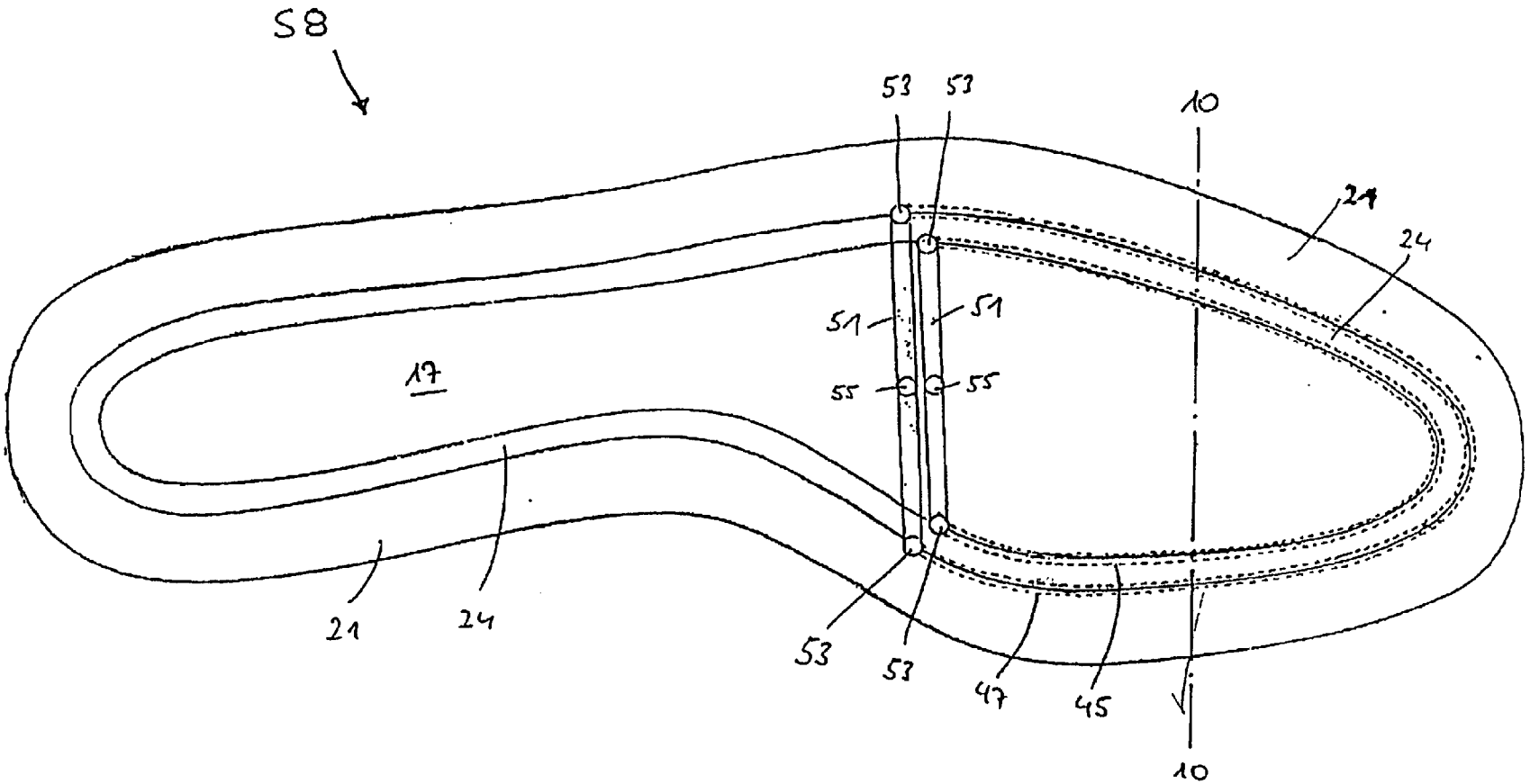
FIG. 14 shows a plan view from below of a shoe according to the invention, which has in the front region a construction according to FIG. 13, before applying an outsole.
Figure 15:
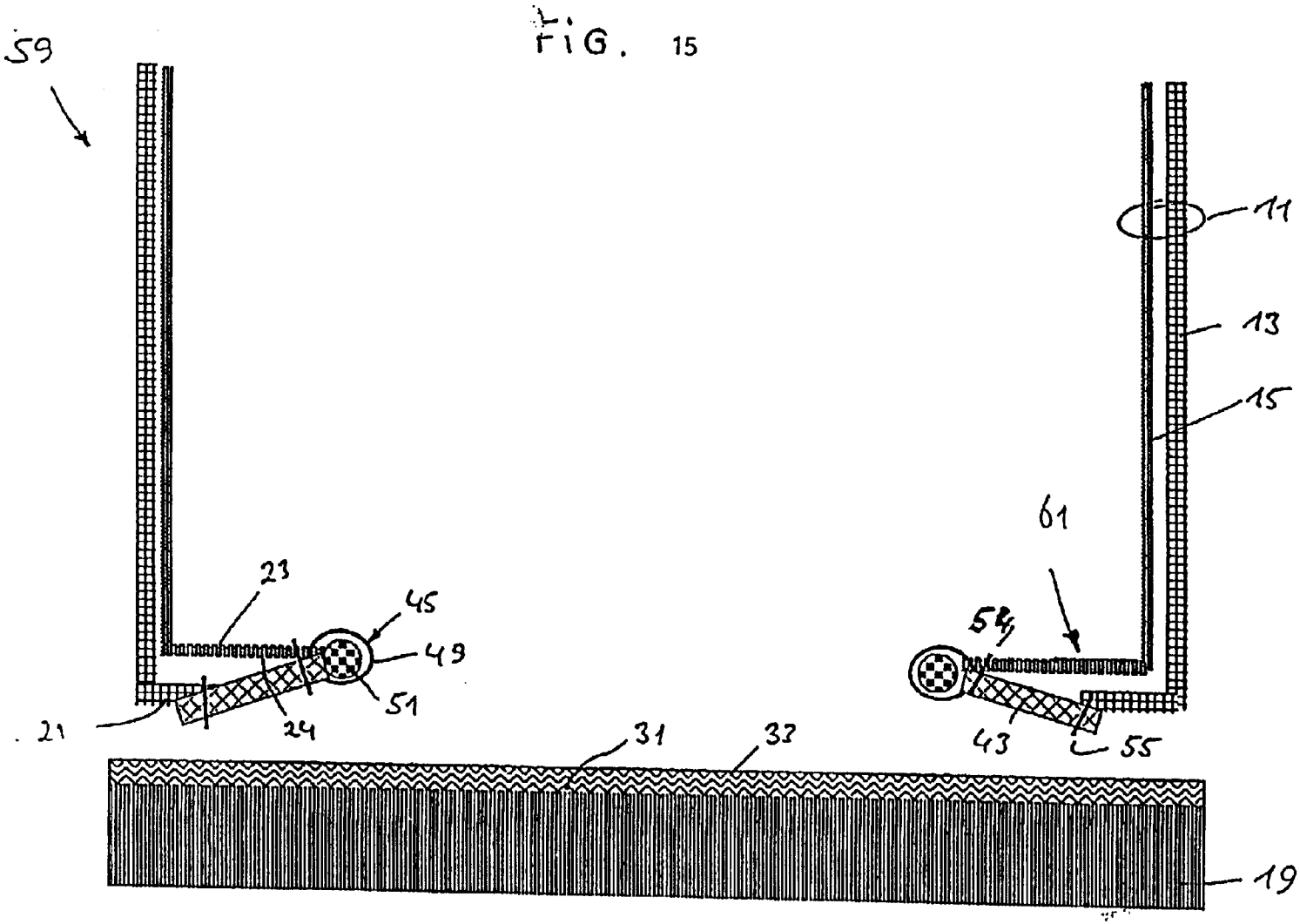
FIG. 15 shows a fourth embodiment of a shoe according to the invention with string-lasting.

The shoes S8 and S9 shown in FIGS. 13–15 are without an insole, at least over part of their shoe length, the upper end region being secured by means of at least one string-lasting in order to keep it in an alignment running essentially parallel to the tread of the outsole.

FIG. 13 shows a shoe construction in which, as in the case of the previous embodiments, the upper 11 is constructed with an outer material 13 with an outer-material end region 21 and a functional layer 15, located within the outer material 13, with a functional-layer end region 23 having an overhang 24. The outsole 19 is flat and is provided with reactive hot-melt adhesive 33, preferably in the form of expanded reactive hot-melt adhesive 33*a,* over its entire outsole top side 31.

The shoe construction shown in FIG. 13 is without an insole. Therefore, after the lasting of the upper 11, the functional-layer end region 23 on the one hand and the outer-material end region 21 on the other hand are each kept by a string-lasting 45 and 47, respectively, in an alignment parallel to the outsole 19. For this purpose, each of the two string-lastings has a string tunnel 49 and a lasting string 51 accommodated displaceably therein. The string tunnels 49 are fastened to the end of the functional-layer end region 23 and to the end of the outer-material end region 21, respectively, preferably by sewing.

FIG. 14 shows a plan view of the underside of the upper of FIG. 13, that is to say without an outsole 19. This is a shoe which is without an insole only in the front foot region, but has an insole in the middle and rear foot regions. Therefore, the string-lastings 45 and 47 extend only in the front foot region. The string tunnels 49 of the two string-lastings 45 and 47 end essentially where the part-insole begins and at these points the string tunnels 49 in each case have a string outlet 53. The two lasting strings 51 run transversely to the longitudinal direction of the shoe at this point and are each knotted approximately in the middle of this transverse extent at 55.

The drawing-together or lashing-up with the string-lastings 45 and 47 can be carried out before or after the lasting of the upper.

In the middle and rear foot regions, provided with a part-insole 17, the shoe shown in FIG. 9 may have with respect to the insole and upper one of the constructions such as are shown in FIGS. 6 to 9.

The shoe S9 shown in FIG. 15 has, at least in part of its shoe length, a shoe construction which coincides with the shoe construction shown in FIG. 13, with the exception that there is only a single string-lasting 45, arranged at the functional-layer end region 23, and that the overhang 24 of the functional-layer end region 23 is bridged by means of a gauze strip 43. One side of the latter is fastened to the string-lasting 45 by means of a seam 54 and its other side is fastened to the outer-material end region 21 by means of a seam 55.

As in the case of the shoe S8, the shoe S9 may also be provided with different sole constructions in its front foot region and in its middle and rear foot regions.

Figure 16:
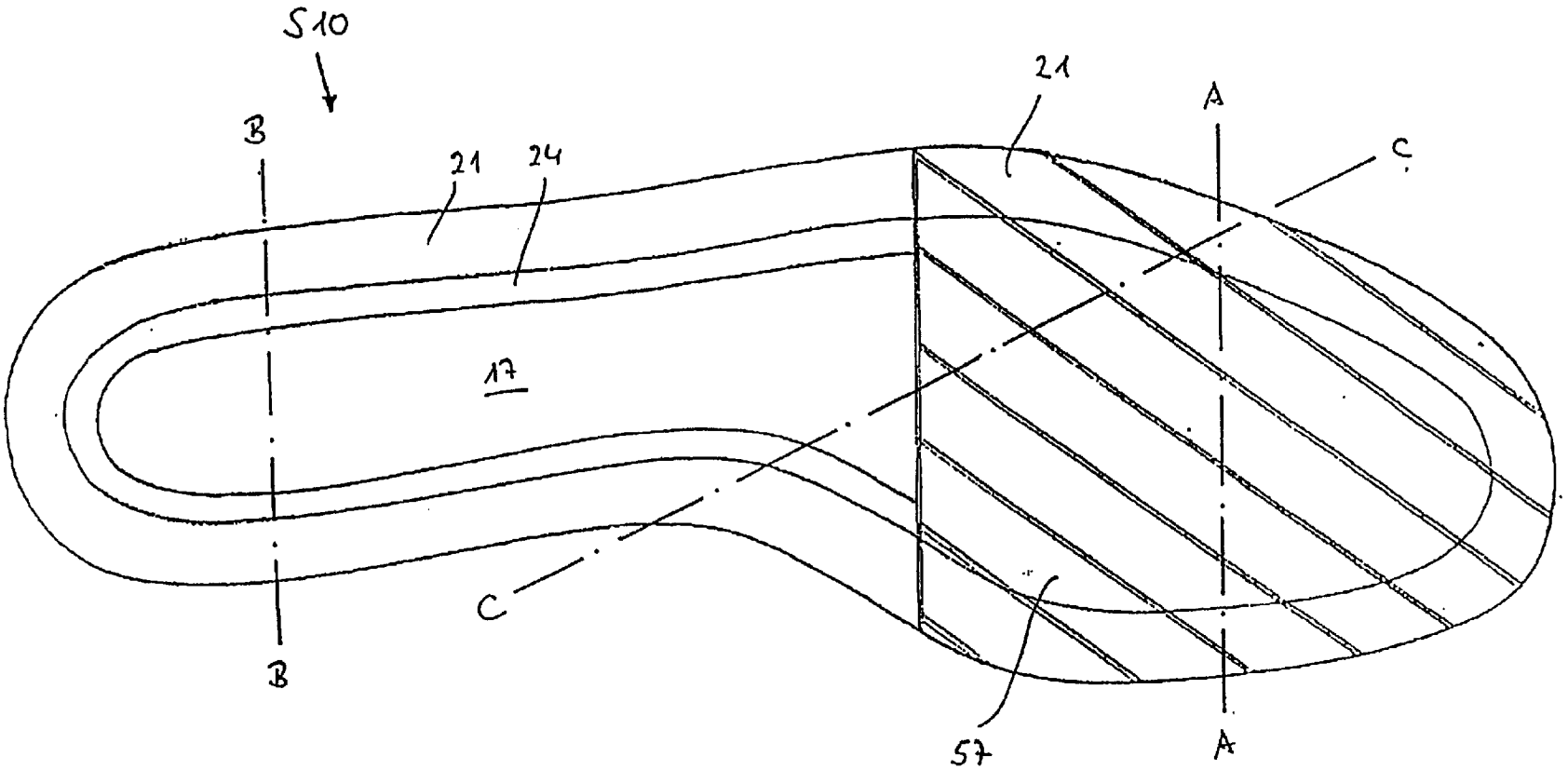
FIG. 16 shows a plan view of an embodiment of a shoe according to the invention using a different technique in the front region and rear region, to be precise in plan view before applying an outsole.
Figure 17:
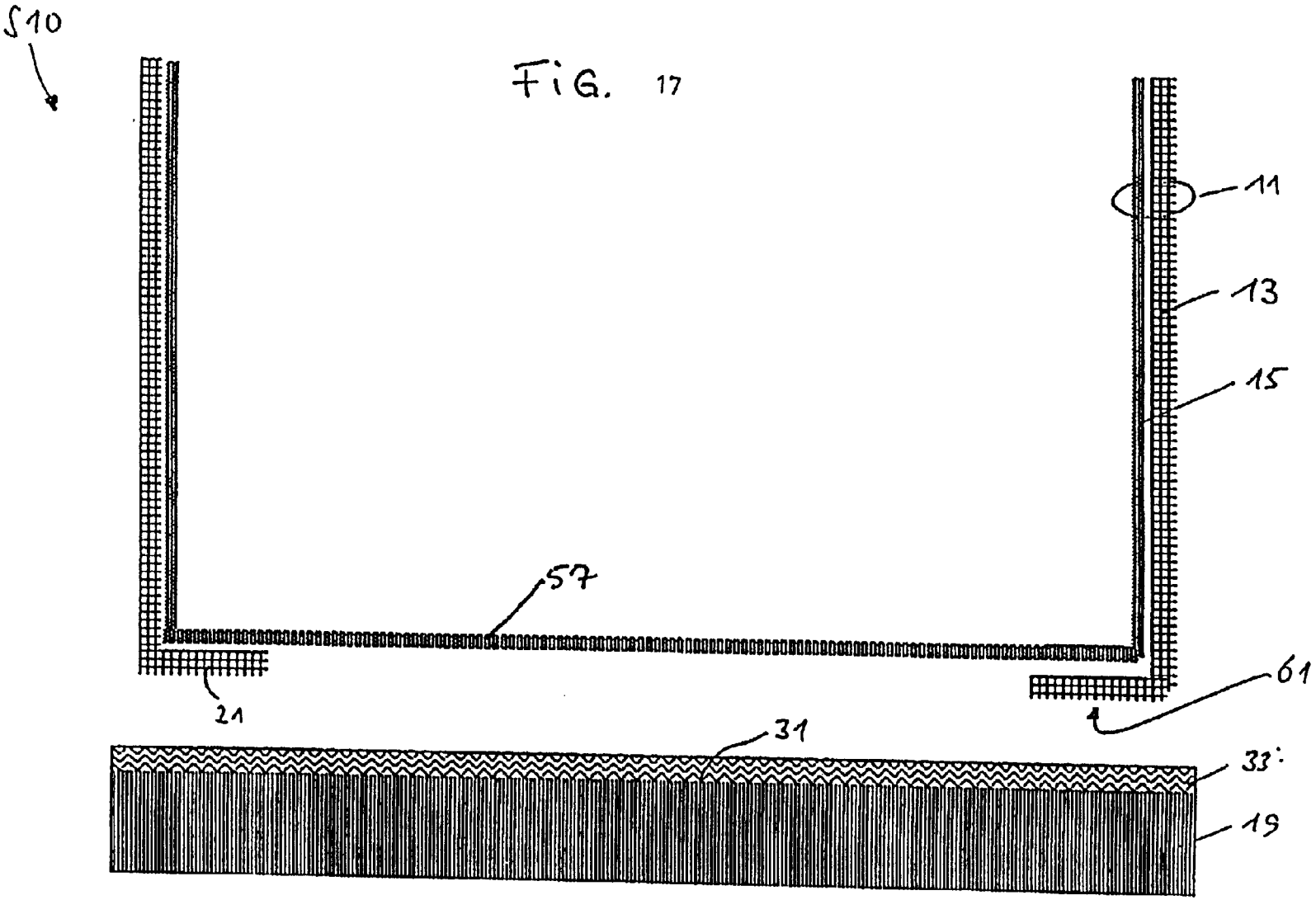
FIG. 17 shows a section through the front foot region of the shoe shown in FIG. 16, to be precise along the sectional line A—A in FIG. 16.
Figure 18:
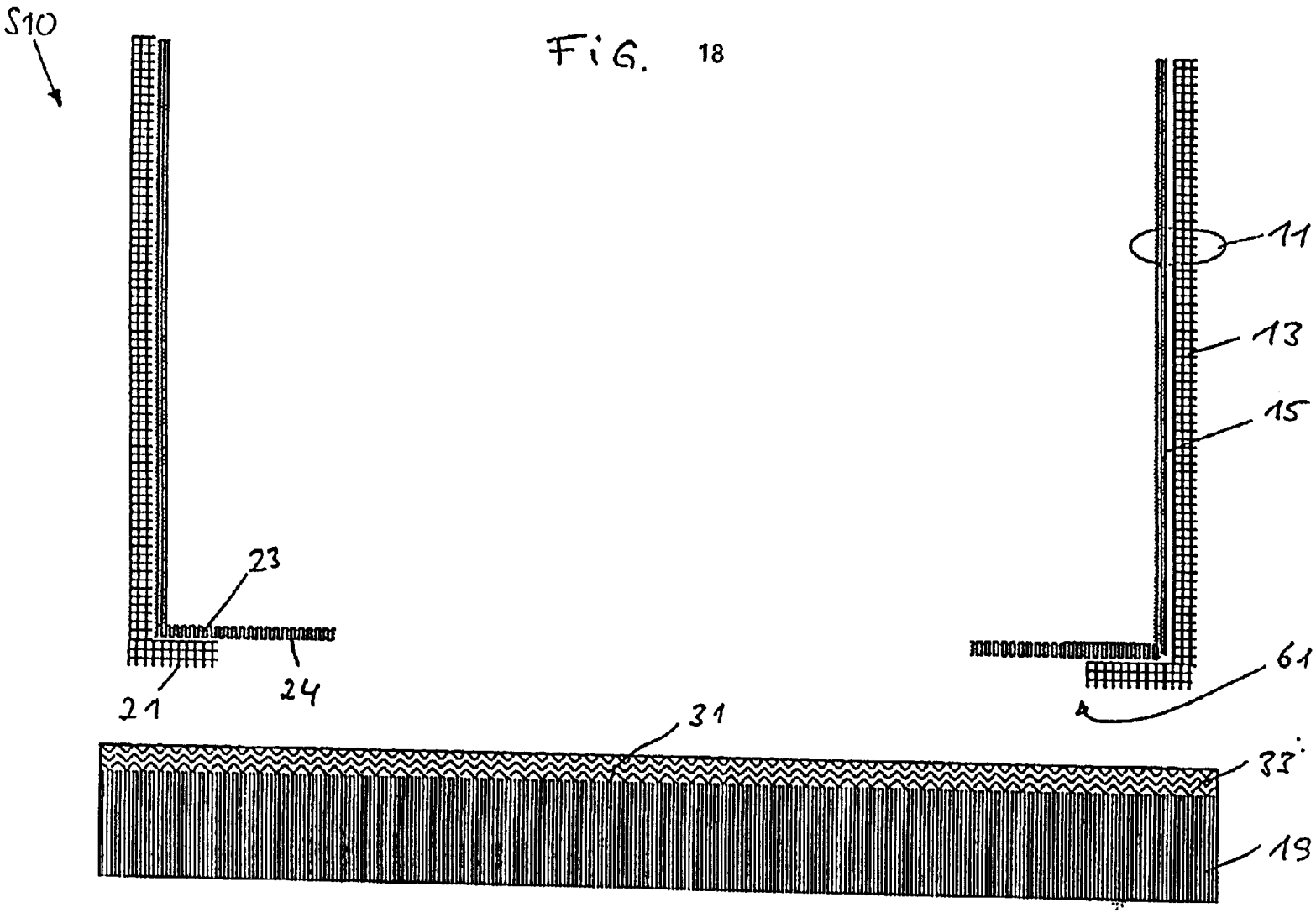
FIG. 18 shows a section through the rear foot region of the shoe shown in FIG. 16, to be precise along the sectional line B—B in FIG. 16.
Figure 19:
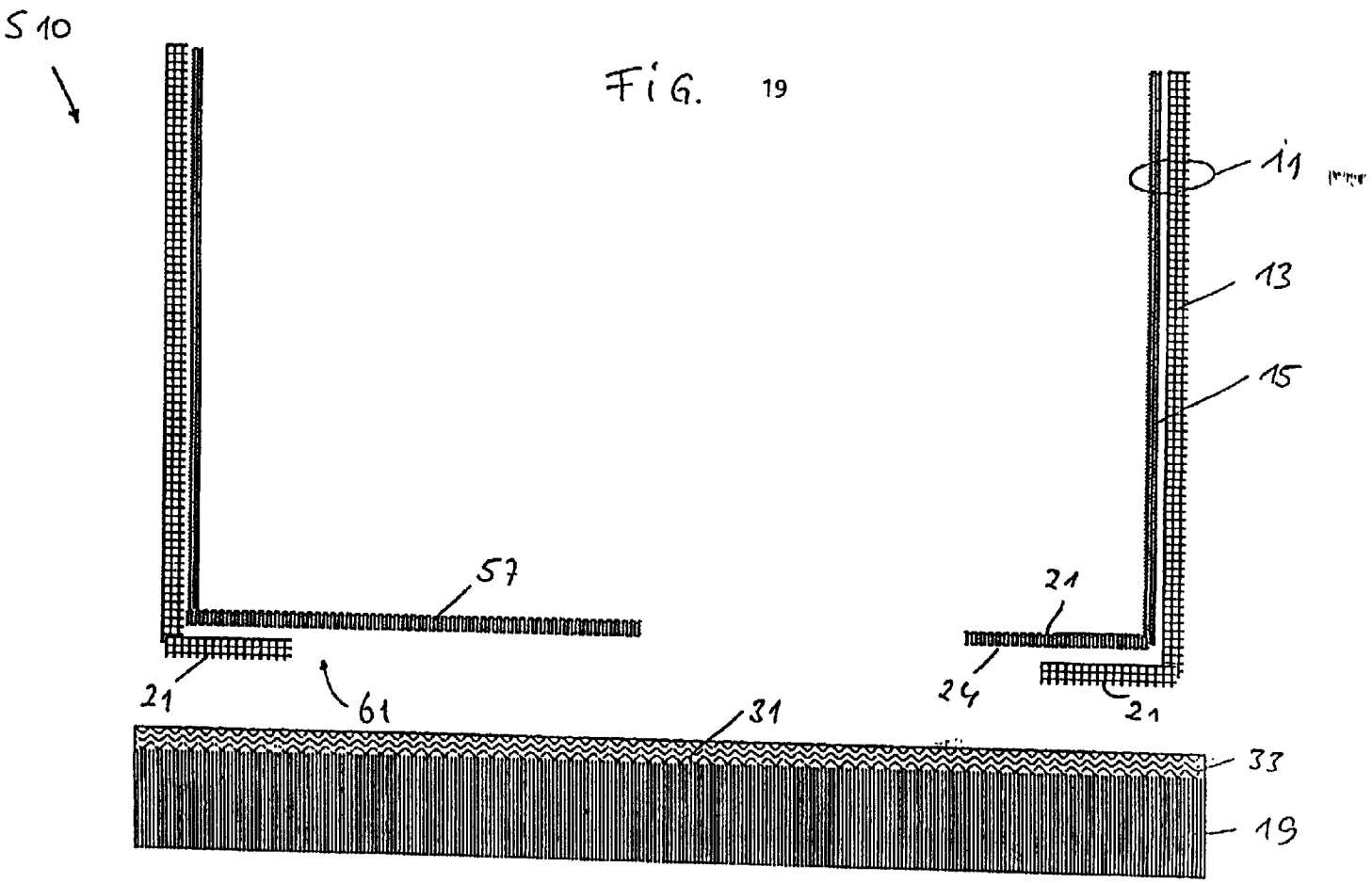
FIG. 19 shows an oblique section through the shoe shown in FIG. 16, to be precise along the sectional line C—C in FIG. 16.

The shoe S10 shown in FIGS. 16 to 19 likewise has a different sole construction in its front foot region than in its middle and rear foot regions. Sectional lines A—A, B—B and C—C are shown in FIG. 16. The associated sectional representations are in FIGS. 17 to 19. FIG. 17 consequently shows a cross section through the front foot region, FIG. 18 shows a cross section through the rear foot region and FIG. 19 shows an oblique section through the front foot region and middle foot region.

The shoe S10 has a functional layer 15, which in the front foot region has the form of a part-sock or part-bootee 57, for which reason the functional layer 15 extends continuously from one top end of the upper over the sole region to the other top end of the upper in the sectional representation in FIG. 17. In the rear foot region, the functional layer 15 of the shoe S10 has an interruption in the sole region, as is also the case in the shoes S1 to S9 considered above. In FIG. 19, the functional layer 15 appears of a different length of extent on the left and right in the part running parallel to the outsole 19. This is because the left-hand part shows an oblique-sectional component of the part-bootee 57, while the right-hand part belongs to a sole construction in which the functional layer ends in a functional-layer end region 23.

In the middle and rear foot regions, the shoe S10 may have any of the sole constructions which have been described above in connection with FIGS. 6–9 and 13–15. That is to say the borders of the functional-layer end region 23 in FIG. 18 may be fastened to an insole, whether by means of a lasting allowance or by sewing, or be kept in their place by string-lasting. In FIGS. 18 and 19, it is therefore left open which of these specific sole constructions is to be used.

With reference to FIGS. 20 to 24, shoes S11 to S14, of which the upper is constructed with a multi-layer laminate which comprises both the outer material and the functional layer, are now considered. In this case there is no overhang of the functional-layer end region with respect to the outer-material end region in the upper end region. To be able nevertheless to seal the functional layer in the upper end region, either a multi-layer laminate with an outer material which can be penetrated by the reactive hot-melt adhesive in liquid form before reacting is used, or the sealing of the functional layer is obtained by the pressing of the outsole onto the upper causing sealing of at least the cut edge of the functional layer at the upper end region, preferably also causing penetration of reactive hot-melt adhesive up to the top side of the multi-layer laminate having the functional layer, remote from the outsole.

Figure 20:
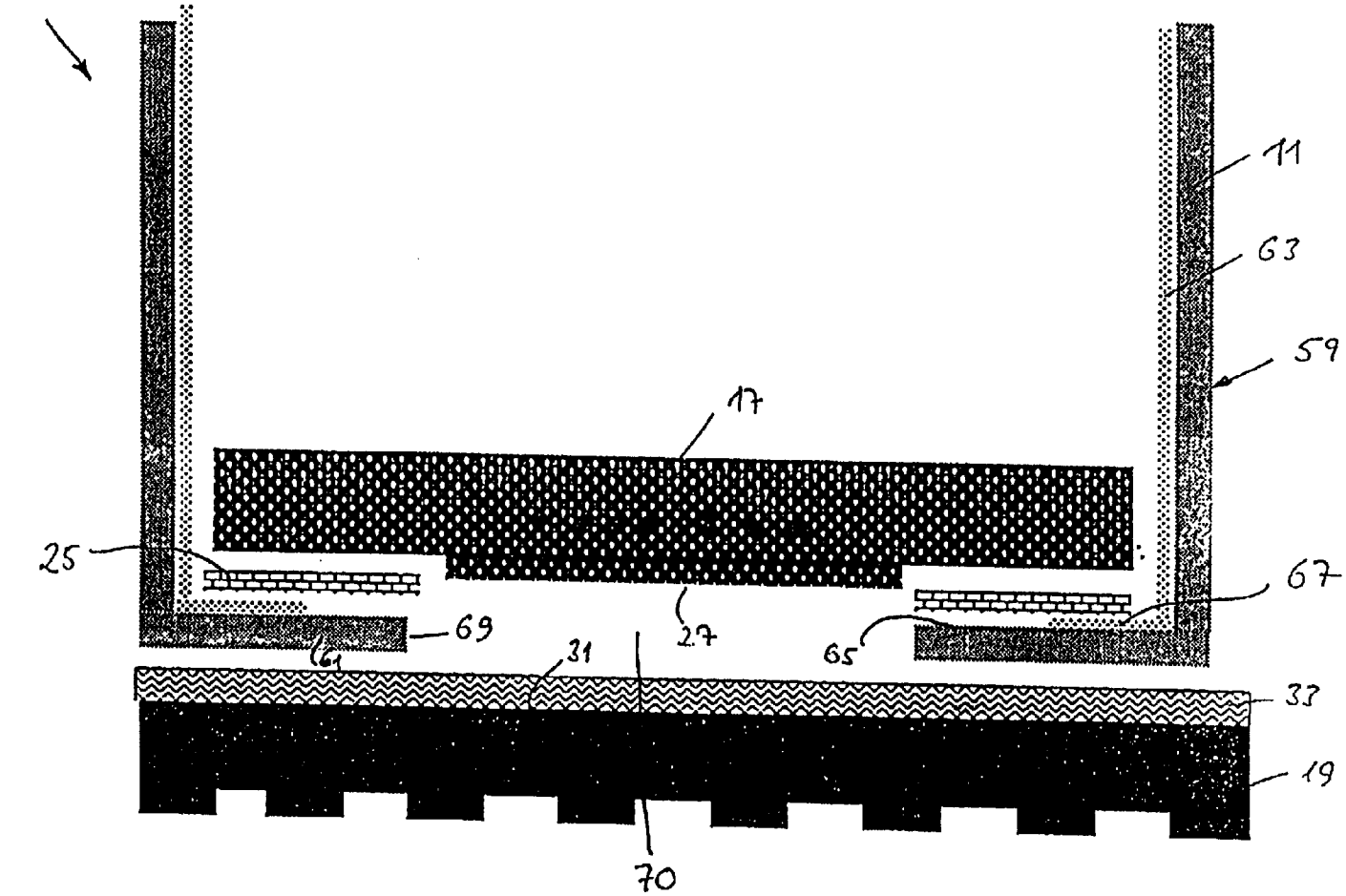
FIG. 20 shows a third embodiment of a shoe according to the invention with a laminate which comprises both an outer material and a functional layer.

The shoe S11 shown in FIG. 20 coincides with regard to the sole construction largely with the shoe S1 shown in FIG. 6. Since the upper 11 consists of a multi-layer laminate 59, which comprises both the outer material and the functional layer, there is no overhang of the functional layer with respect to the outer material in an upper end region 61 running parallel to the outsole 19. The multi-layer material 59 is lined on its inner side with a lining 63 of conventional lining material. The upper end region 61 is cemented to the insole underside 27 by means of lasting cement 25. The upper end region 61 has an upper overhang 65 beyond a lining end region 67. Since the lasting cement 25 reaches up to the edge of the upper end region 61, the reactive hot-melt adhesive 33 applied to the outsole 19 cannot penetrate to the top side of the upper overhang 65 facing the insole, but only up to a cut edge 69 of the upper end region 61. This seals the cut edge 69 of the functional layer, which is already adequate for achieving a waterproof sole construction.

If the outer material used for the multi-layer laminate 59 can be penetrated by the reactive hot-melt adhesive 33 in liquid form before reacting, a sealing means of the reactive hot-melt adhesive 33 over the entire surface area of the upper end region 61.

Figure 21:
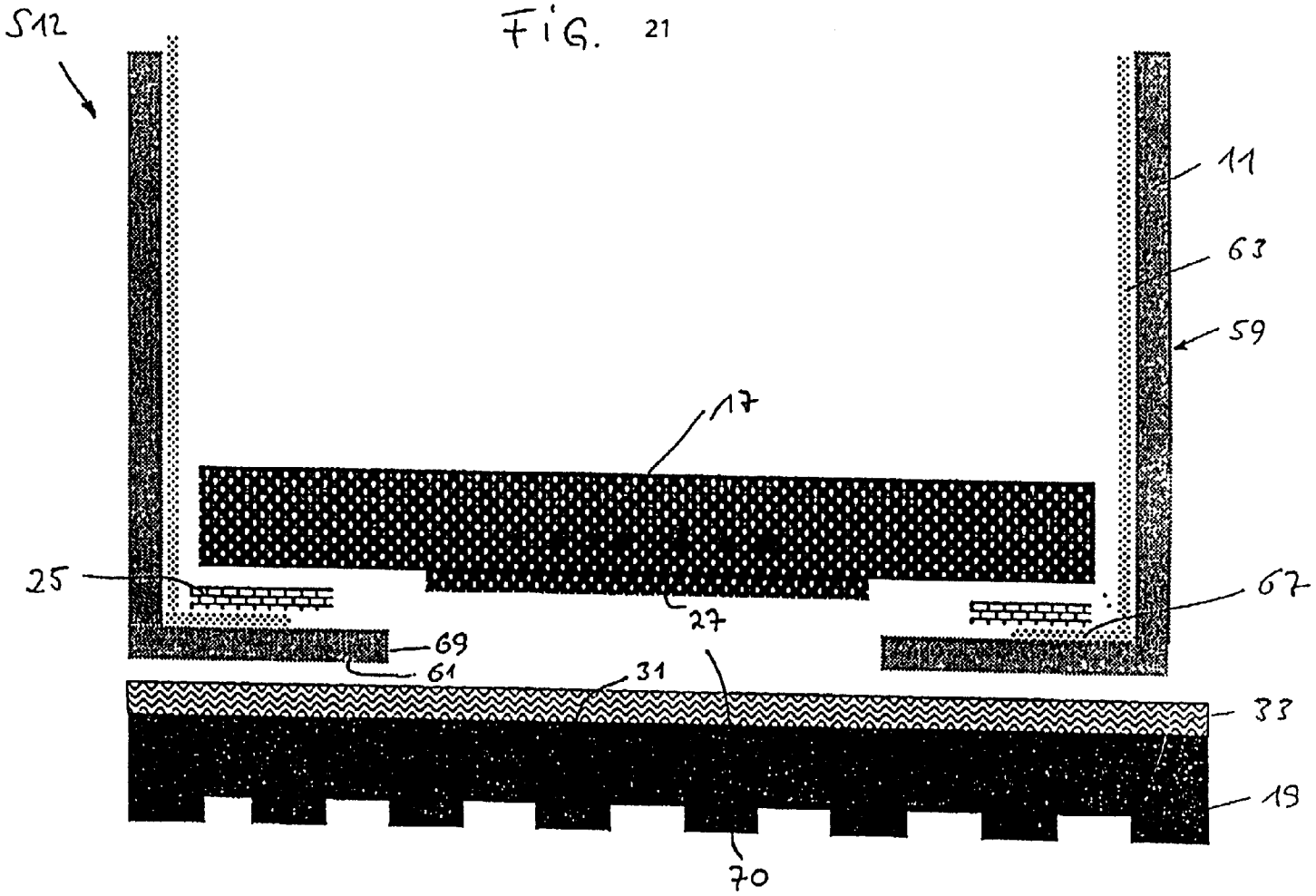
FIG. 21 shows a fourth embodiment of a shoe according to the invention with a laminate which comprises both an outer material and a functional layer.

The shoe S12 shown in FIG. 21 has a construction which is very similar to that of the shoe S11. The only difference is that the lasting cement 25 does not extend over the entire upper end region 61 but instead the region of the upper end region 61 adjacent to the cut edge 69 is free from lasting cement 25, and consequently is not cemented to the insole underside 27. This allows particularly good penetration of reactive hot-melt adhesive 33 between the insole 17 and the region of the upper end region 61 not cemented during cement-lasting while the insole 19 is pressed onto the upper end region 61 and the insole 17. This embodiment is particularly advantageous if the outer material of the multi-layer laminate 59 cannot be penetrated, or cannot be penetrated adequately, by the reactive hot-melt adhesive still in liquid form before reacting.

Figure 22:
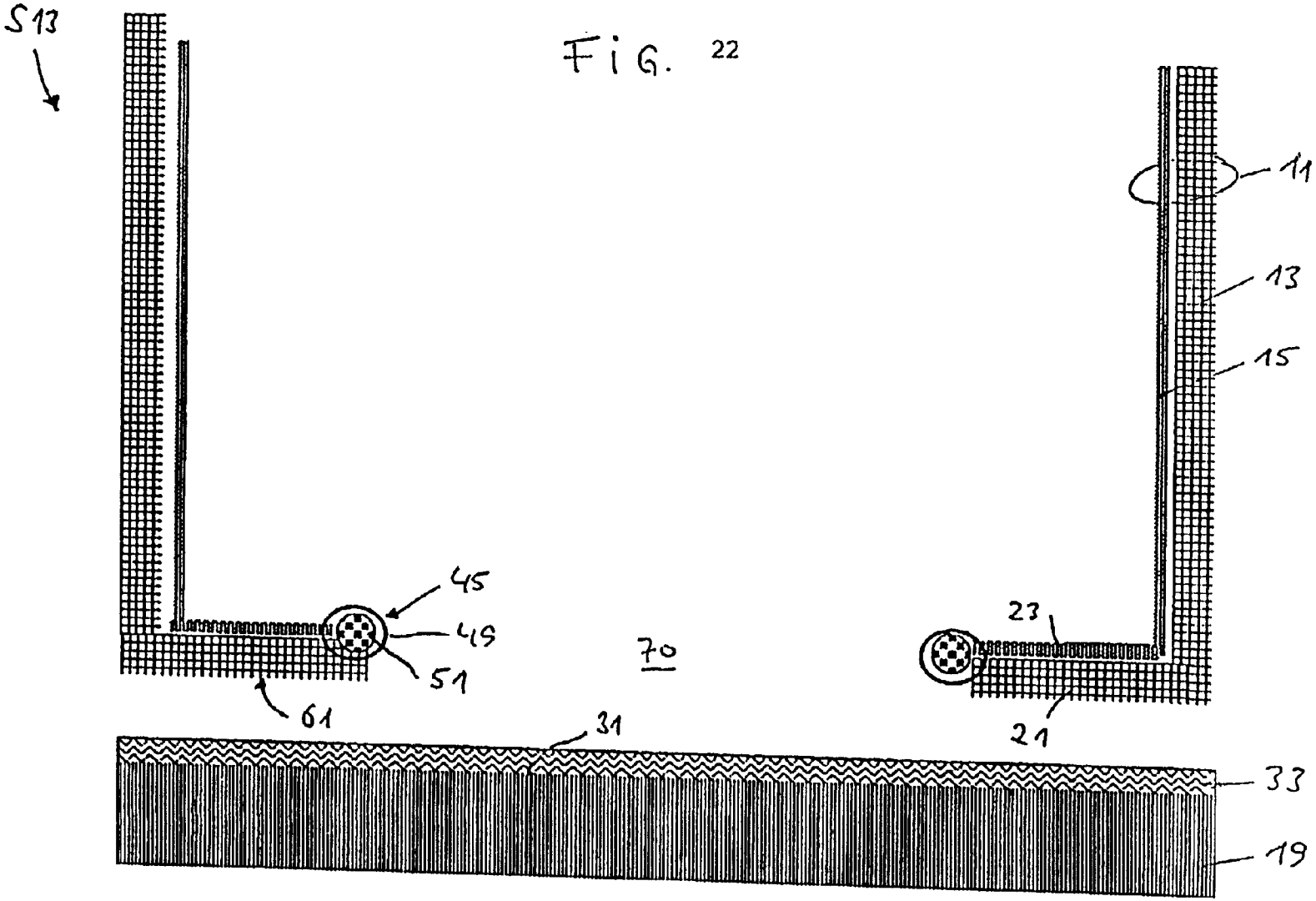
FIG. 22 shows a fifth embodiment of a shoe according to the invention with a laminate which comprises both an outer material and a functional layer.

The shoe S13 shown in FIG. 22 has a construction which is very similar to the construction of the shoe S8 shown in FIG. 13. The upper 11 of the shoe S13 is likewise constructed with an outer material 13 and a separate functional layer 15. However, the outer-material end region 21 and the functional-layer end region 23 are cut to the same length. Therefore, there is not the overhang 24 of the functional-layer end region 23 that there is in the case of the shoe S8. For this reason, the ends of the outer-material end region 21 and of the functional-layer end region 23 can be jointly joined by a single string-lasting 45. A single lasting string 51 is therefore adequate for lashing up the outer-material end region 21 and the functional-layer end region 23.

Figure 23:
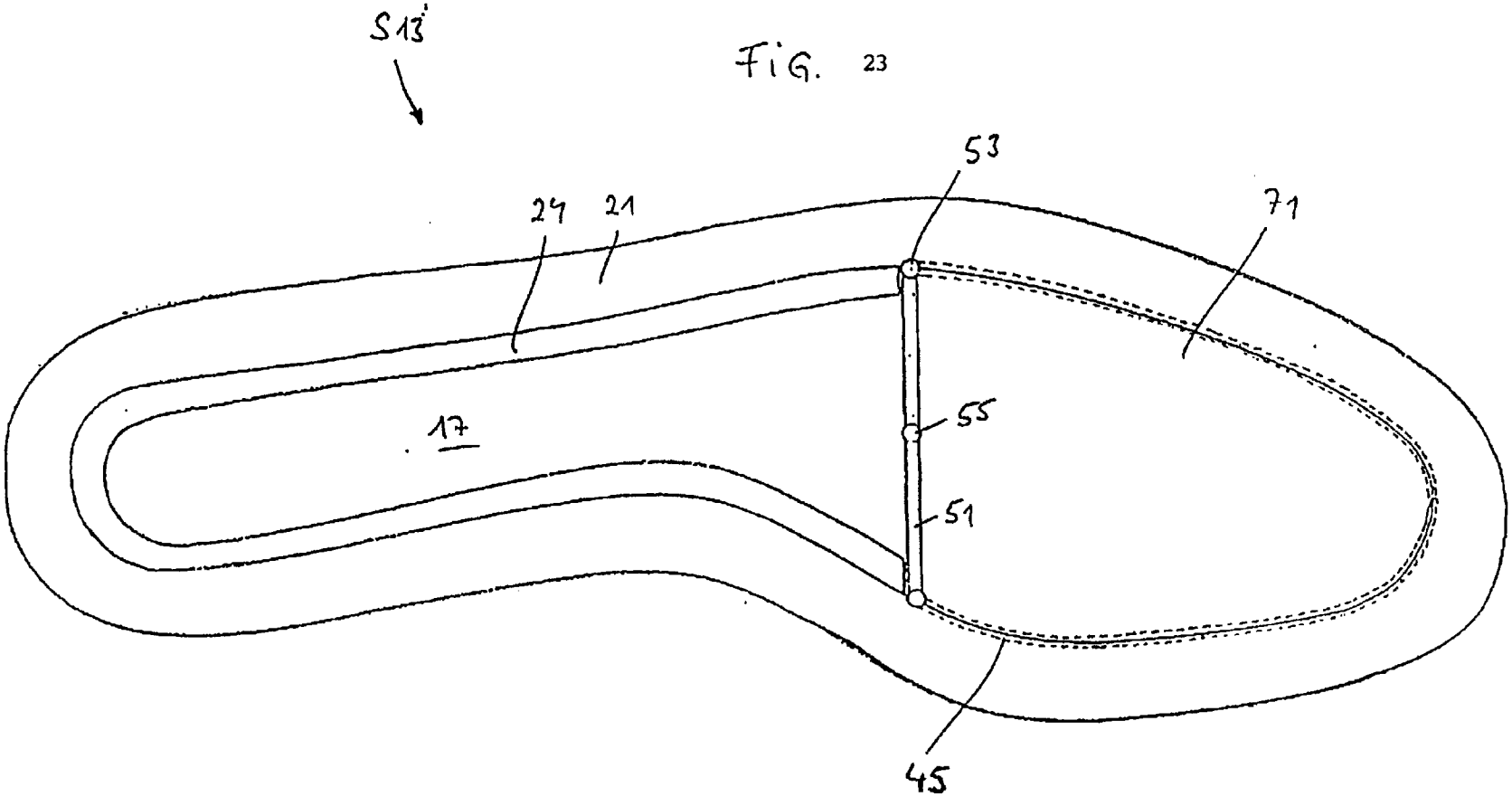
FIG. 23 shows a plan view from below of the shoe shown in FIG. 22 before applying an outsole.

A modification of the shoe construction shown in FIG. 23 may comprise using a multi-layer laminate 59, as in the case of the shoes S11 and S12, instead of the outer material 13 and the functional layer 15 separate from the latter.

Shown in FIG. 23 is a plan view from below of a shoe before applying the outsole, which shoe has in the front foot region 71 the sole construction shown in FIG. 22, while it has in the middle and rear foot regions a sole construction for example of the kind shown in FIG. 6.

Shoes which are without an insole in the front foot region, such as the shoes shown in FIGS. 14 and 23 for example, are much more flexible in the front foot region than shoes with an insole in the front foot region as well, which makes them feel particularly soft during walking.

Figure 24:
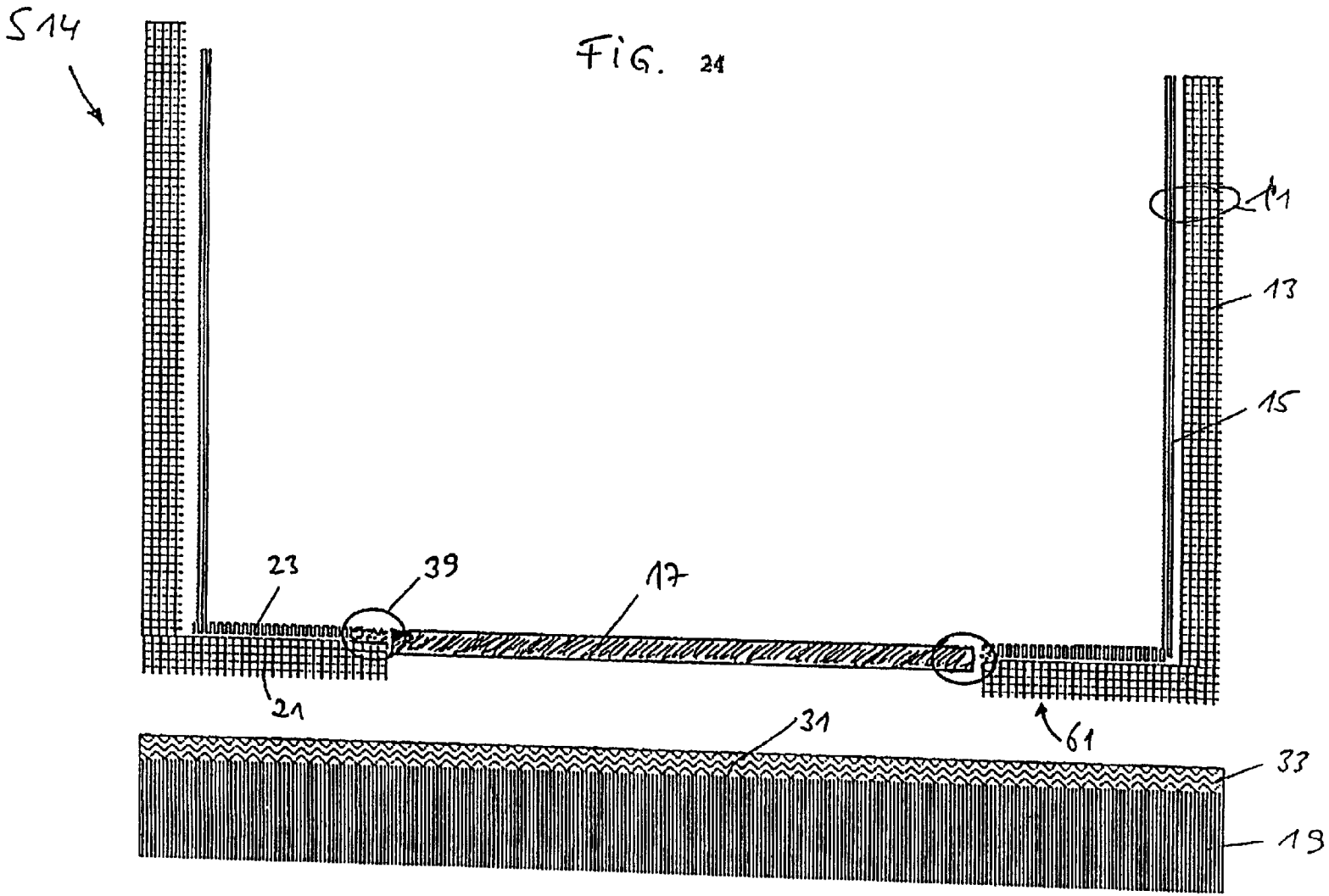
FIG. 24 shows a sixth embodiment of a shoe according to the invention with a laminate comprising an outer material and a functional layer, the laminate being joined to an insole by means of a Strobel seam.

The construction of the shoe S14 shown in FIG. 24 coincides with the shoe construction shown in FIG. 22, with the exception that the outer-material end region 21 and the functional-layer end region 23 are not secured by means of string-lasting but are fastened to an insole 17 by means of a seam 39, preferably a Strobel seam, as already shown and described in connection with FIG. 9.

This shoe construction is also suitable for the case in which the upper 11 is constructed with a multi-layer laminate.

Two further embodiments of footwear according to the invention, in which the upper end region is joined to an insole by means of a gauze strip, are now considered.

Figure 25:
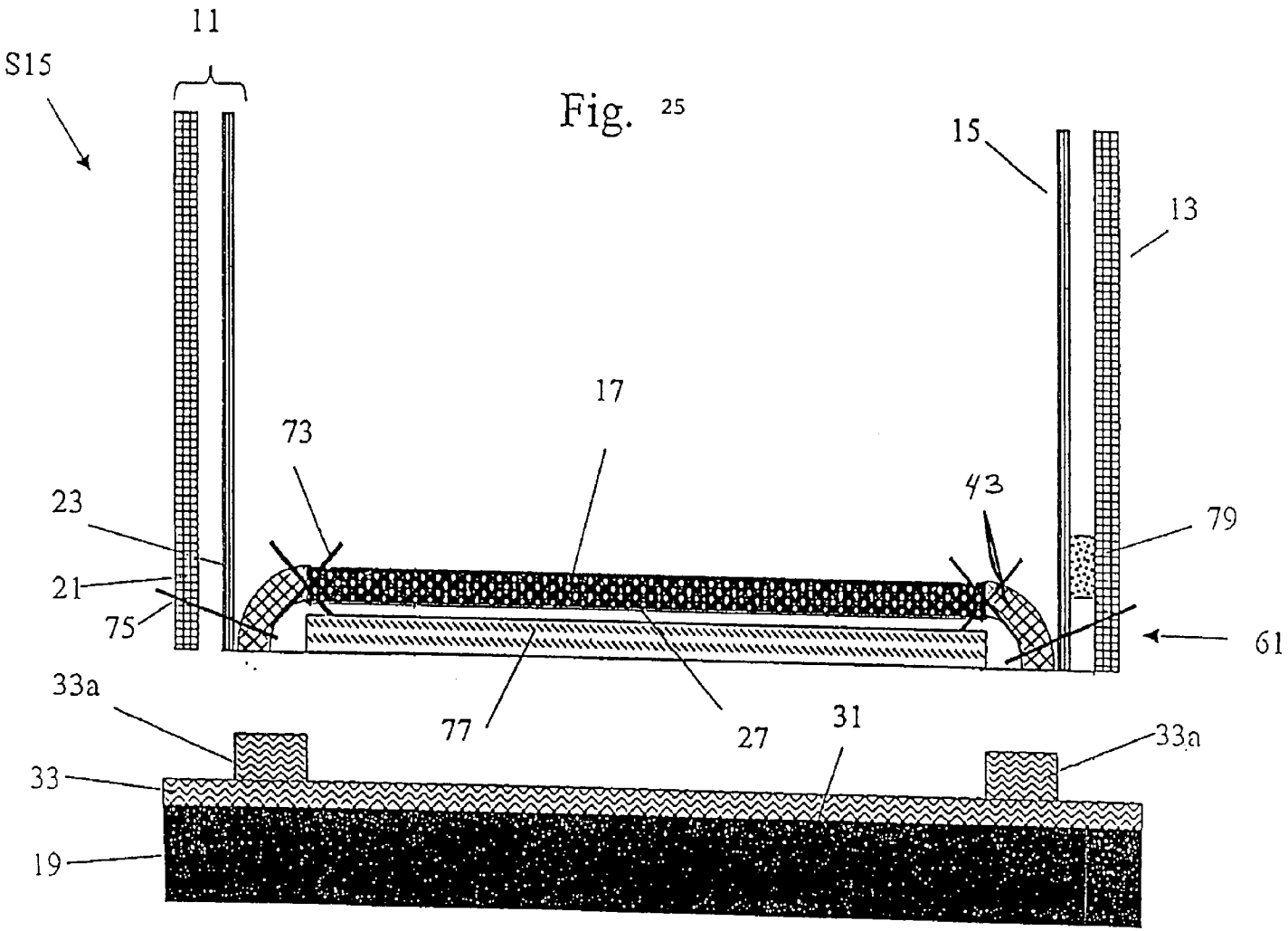
FIG. 25 shows a third embodiment of a shoe according to the invention with a gauze strip arranged between the insole and the functional layer.

The shoe S15 shown in FIG. 25 has an upper 11, which is constructed with an outer material 13 and with a separate functional layer 15 located on the inner side of the latter. In this case, an insole 17 is joined both to an outer-material end region 21 on the sole side and to a functional-layer end region 23 on the sole side via a gauze strip 43, which is located between the functional-layer end region 23 and the insole. A seam 73 joins an inner side edge of the gauze strip 43 to the insole 17. A seam 75 joins an outer side edge of the gauze strip 43 to the outer-material end region 21 and to the functional-layer end region 23. The gauze strip 43 lies between the insole 17 and the end regions 21 and 23 of the outer material 13 and the functional layer 15. In the way shown in FIG. 20, between the underside 27 of the insole and the outsole 19 there may be a sheet-like filler 77, preferably of soft material, which may be a nonwoven fabric, in particular a PES nonwoven, a knitted fabric or insole material or other sole material which can be cemented to the underside 27 of the insole. The two side edges of the gauze strip 43 may lie at different levels. Between the two side edges, the gauze strip 43 may be curved.

An outsole 19 is provided on its top side 31 facing the insole with a coating of reactive hot-melt adhesive 33 over the full surface area. At those points which lie opposite the gauze strip 43 after adhesively attaching the outsole 19 to the upper 11 and the filler 77, additional, preferably expanding reactive hot-melt adhesive 33*a* is applied to the top side 31 of the outsole. In its liquid or liquefied state before fully reacting, this adhesive penetrates through the gauze strip 43 and effects a sealing of the functional-layer end region 23 and the seams 73 and 75.

For easier handling of the upper 11, in particular before and during the production of the seam 75, the outer-material end region 21 and the functional-layer end region 23 may be fastened on each other by means of a fixing adhesive 79 located between them. To indicate that the fixing adhesive 79 does not have to be present, it is represented in FIG. 20 only on the right-hand side. If it is used, it goes without saying that it runs around the entire upper end region 61. Any desired adhesive may be used as the fixing adhesive 79, for example a hot-melt adhesive or a solvent adhesive, for example PU-based.

Figure 26:
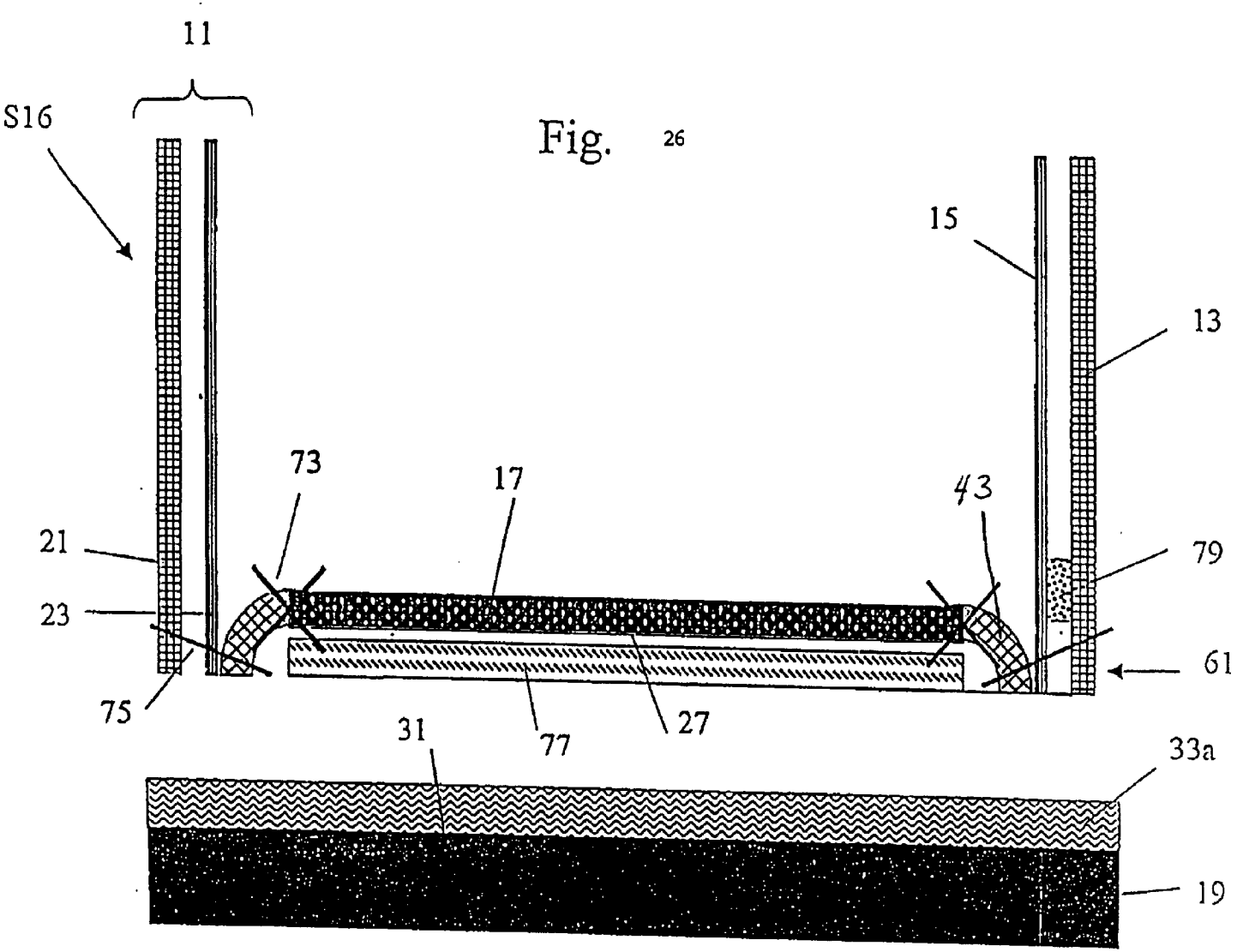
FIG. 26 shows a fourth embodiment of a shoe according to the invention with a gauze strip arranged between the insole an d the functional layer.

The shoe S16 shown in FIG. 26 has a construction which is very similar to that of the shoe S15 of FIG. 25 and differs from it only in that the surface 31 of the outsole is provided with foaming reactive hot-melt adhesive 33, in particular with foamed reactive hot-melt adhesive 33*a*, over the full surface area and with the same thickness.

If footwear according to the invention has a water-permeable outsole and a water-permeable insole, the sole construction can be made waterproof by applying reactive hot-melt adhesive to the entire outsole. If a waterproof insole and/or a waterproof outsole are used for a shoe according to the invention, it is sufficient to apply reactive hot-melt adhesive to that zone of the outsole which lies opposite the region of the functional layer to be sealed in the upper end region. Conventional outsole cement, for example solvent adhesive or hot-melt adhesive, can then be applied to the remaining region of the outsole.

The outsole of footwear according to the invention may consist of waterproof material, such as for example rubber or plastic, for example polyurethane, or of non-waterproof, but breathable material, such as in particular leather or leather provided with rubber or plastic intarsias. In the case of non-waterproof outsole material, the outsole can be made waterproof, while maintaining breathability, by being provided with a waterproof, water-vapour-permeable functional layer at least at points at which the sole construction has not already been made waterproof by other measures.

Also in shoe constructions other than the shoe constructions shown in FIGS. 25 and 26, of which the upper is constructed with an outer material and a functional layer separate from the latter, for example of the kind shown in FIG. 6, handling during shoe production can be facilitated if the outer-material end region is fixed to the functional-layer end region by means of a fixing adhesive before the outsole is cemented on. This is not absolutely necessary, however, since the outer-material end region is secured by the outsole once the latter has been cemented on.

A shoe according to the invention is produced by producing and lasting the upper with or without an insole, the individual production steps required for this depending on the specific construction of the shoes S1 to S16 shown in the figures. Then cement is applied to a prefabricated outsole, it being possible for the cement to be exclusively non-expanded reactive hot-melt adhesive, exclusively expanded reactive hot-melt adhesive, partly expanded and partly non-expanded reactive hot-melt adhesive, or partly reactive hot-melt adhesive and partly conventional outsole cement, for example solvent adhesive, depending on the type of shoe to be produced. Then the outsole is pressed onto the lasted upper, whereby the intended sealing of the functional layer takes place. Once the adhesive bond and curing of the adhesive comes into effect, the shoe is finished.

Figure 27:
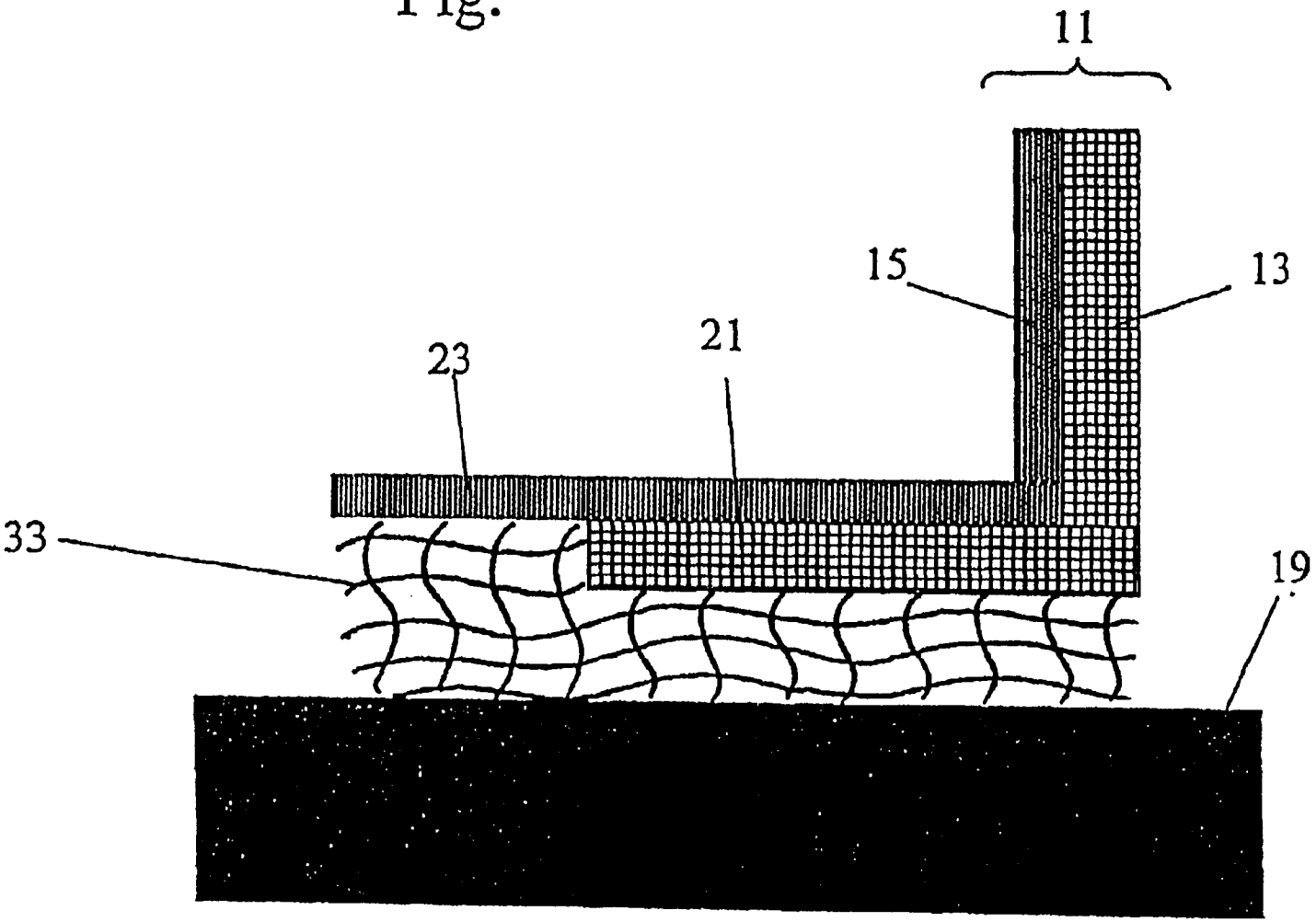
FIG. 27 shows a schematized, greatly enlarged two-dimensional representation of reactive hot-melt adhesive fully reacted by three-dimensional crosslinking of molecule chains.

FIG. 27 shows in a schematized, not-to-scale, greatly enlarged, two-dimensional representation a detail of a sole construction with outsole cement in the form of reactive hot-melt adhesive 33 fully reacted by three-dimensional crosslinking of molecule chains. The three-dimensionality of the crosslinking is created by the molecule chains of the reactive hot-melt adhesive 33 crosslinking also in the third dimension (perpendicular to the surface of the drawing), not visible in FIG. 27, in the way represented for two dimensions. This provides particularly strong protection against the penetration of water into the adhesive.

What is claimed is:

1. Footwear with an upper and a sole construction having an outsole, in which:

the upper is constructed with an outer material having an inner side and an outer side and with a waterproof functional layer at least partially lining the outer material on the inner side and having an upper end region with an outer-material end region and a functional-layer end region;

the functional-layer end region has a region requiring sealing; and the outsole is adhesively bonded to the upper end region by means of outsole cement located on it, the outsole cement being formed at least in a subregion of the outsole lying opposite the region requiring sealing of the functional-layer end region by a reactive hot-melt adhesive which is in direct contact with the functional-layer end region and which brings about waterproofness when in the fully reacted state.

2. Footwear according to claim 1, in which the functional-layer end region has an overhang projecting beyond the outer-material end region, and the outsole cement is formed at least in a subregion of the outsole which is closed in the direction of the sole periphery and lies opposite at least part of the width of the overhang by a reactive hot-melt adhesive which brings about waterproofness when in the fully reacted state.

3. Footwear according to claim 2, in which the reactive hot-melt adhesive extends over the entire width of the overhang.

4. Footwear according to claim 2, in which the upper end region extends essentially parallel to the tread of the outsole and the functional-layer end region projects beyond the outer-material end region in the direction of the center of the outsole.

5. Footwear according to claim 4, in which the functional-layer end region is kept essentially parallel to the tread of the outsole by means of string-lasting.

6. Footwear according to claim 5, in which the overhang is bridged by a gauze strip, one side of which is fastened to the outer-material end region and the other side of which is fastened to the string-lasting.

7. Footwear according to claim 5, in which the outer-material end region is kept essentially parallel to the tread of the outsole by means of a second string-lasting.

8. Footwear according to claim 2, in which the upper end region extends essentially perpendicular to the tread of the outsole and the functional-layer end region projects beyond the outer-material end region in the direction of the tread.

9. Footwear according to claim 2, with an insole, to which the functional-layer end region is fastened.

10. Footwear according to claim 9, in which the functional-layer end region is joined to the insole by means of a seam.

11. Footwear according to claim 9, in which the functional-layer end region is joined to the insole by cement-lasting.

12. Footwear according to claim 9, in which the outer-material end region is secured to the functional-layer end region by means of adhesive.

13. Footwear according to claim 9, in which the overhang is bridged by a gauze strip, one side of which is fastened to the outer-material end region and the other side of which is fastened to the insole.

14. Footwear according to claim 1, in which the upper end region has an upper-end-region outer side remote from the functional layer and the outsole cement is formed at least in a subregion of the upper-end-region outer side which is closed in the direction of the sole periphery by reactive hot-melt adhesive and the outer material consists at least in this subregion of a material which can be penetrated by the reactive hot-melt adhesive that is liquid before fully reacting, so that in this subregion the reactive hot-melt adhesive adhesively bonds the functional layer with a sealing effect.

15. Footwear according to claim 14, in which the outer material and the functional layer are each part of a multilayer laminate.

16. Footwear according to claim 14, in which the upper end region extends essentially parallel to the tread of the outsole.

17. Footwear according to claim 14, in which the upper end region extends essentially perpendicular to the tread of the outsole.

18. Footwear according to claim 14, with an insole, to which the upper end region is fastened.

19. Footwear according to claim 18, in which the upper end region is joined to the insole by means of a seam.

20. Footwear according to claim 18, in which the upper end region is joined to the insole by cement-lasting.

21. Footwear according to claim 20, in which a region of the upper end region adjacent to an upper end region edge is excepted from the cement-lasting.

22. Footwear according to claim 14, in which the upper end region is kept essentially parallel to the tread of the outsole by means of string-lasting.

23. Footwear according to claim 1, in which the upper end region has an upper-end-region outer side remote from the functional layer, the upper end region has an upper end edge, within which a free zone, free from upper material, is formed and the outsole cement is formed at least in a region of the free zone which is closed in the direction of the sole periphery and is adjacent to the upper end edge by reactive hot-melt adhesive which has penetrated between the insole underside and the functional-layer end region and forms there a cementing region closed in the direction of the sole periphery.

24. Footwear according to claim 1, in which the outsole is essentially flat.

25. Footwear according to claim 1, in which the outsole essentially has turned-up edges with a flat tread region and a border rising up from the latter in an essentially perpendicular direction.

26. Footwear according to claim 1, in which the outsole is provided with reactive hot-melt adhesive in that subregion in which it lies opposite the region of the functional layer to be sealed and is otherwise provided with conventional outsole cement.

27. Footwear according to claim 1, in which the outsole is provided with reactive hot-melt adhesive essentially over its entire top side facing the upper.

28. Footwear according to claim 1, in which at least part of the reactive hot-melt adhesive located on the outsole is formed by an expanded reactive hot-melt adhesive.

29. Footwear, according to claim 1, in which the sole construction comprises an insole and a gauze strip, the gauze strip is arranged between the insole and the upper end region, and a first side edge of said gauze strip being joined to the insole and a second side edge of said gauze strip being joined both to the outer-material end region and to the functional-layer end region.

30. Footwear according to claim 29, in which the outsole cement is formed at least in a subregion of the outsole which is closed in the direction of the sole periphery and lies opposite the gauze strip by a reactive hot-melt adhesive.

31. Footwear according to claim 30, in which the outsole cement is formed at least in a subregion of the outsole which is closed in the direction of the sole periphery and lies opposite the gauze strip by an expanded reactive hot-melt adhesive.

32. Footwear according to claim 30, in which the entire outsole surface is provided with reactive hot-melt adhesive.

33. Footwear according to claim 30, in which the entire outsole surface is provided with expanded reactive hot-melt adhesive.

34. Footwear according to claim 30, in which a filler is arranged between the insole underside and the outsole top side.

35. Footwear according to claim 30, in which the gauze strip is sewn both to the insole and to the outer-material end region as well as to the functional-layer end region.

36. Footwear according to claim 30, in which the outer-material end region and the functional-layer end region are fastened to each other by means of a fixing adhesive.

37. Footwear according to claim 1, which has a part-insole over part of the shoe length in which the footwear is constructed, and is constructed in the remaining part of the shoe length.

38. Footwear which in a front foot region has a sole construction according to claim 1 and in a rear foot region has a shoe construction.

39. Process for the production of footwear, having the following production steps:

a) an upper is created, constructed with an outer material having an inner side and an outer side and with a waterproof functional layer at least partially lining the outer material on the inner side and provided with an upper end region;

b) the outer material is provided with an outer-material end region and the functional layer is provided with a functional-layer end region, a region requiring sealing being created at the functional-layer end region;

c) outsole cement is applied to an outsole and the outsole is adhesively attached to the upper end region, a reactive hot-melt adhesive which is in direct contact with the functional-layer end region and which brings about waterproofness when in the fully reacted state being applied as outsole cement at least in a subregion of the outsole which lies opposite the region of the functional-layer end region requiring sealing after the adhesive attachment of the outsole.

40. Process according to claim 39, in which the functional-layer end region is provided with an overhang projecting beyond the upper-material end region and reactive hot-melt adhesive is applied as outsole cement at least in a subregion of the outsole which is closed in the direction of the sole periphery and lies opposite at least part of the width of the overhang after the adhesive attachment of the outsole.

41. Process according to claim 39, in which reactive hot-melt adhesive is applied as outsole cement at least in a subregion of the outsole which is closed in the direction of the sole periphery and lies opposite at least part of the upper-end-region outer side after the adhesive attachment of the outsole, the outer material being produced at least in this subregion from a material which can be penetrated by the reactive hot-melt adhesive that is liquid or liquefied before fully reacting, so that there the reactive hot-melt adhesive brings about a sealing adhesive bonding of the functional layer.

42. Process according to claim 39, in which the upper end region is provided with an upper end edge, within which a free zone, free from upper material, is formed, and reactive hot-melt adhesive is applied as outsole cement at least in a subregion of the outsole which is closed in the direction of the sole periphery and lies opposite at least one region of the free zone adjacent to the upper end edge after the adhesive attachment of the outsole and is applied to the outsole at such a rate and the outsole is pressed against the upper-end-region outer side in such a way that reactive hot-melt adhesive penetrates between the insole underside and the functional-layer end region and forms there an adhesive bonding region which is closed in the direction of the sole periphery.

43. Process according to claim 39, in which the sole construction is provided with an insole, a gauze strip is arranged between the insole and the upper end region, a first side edge of which strip being joined to the insole and a second side edge being joined both to the outer-material end region and to the functional-layer end region, and reactive hot-melt adhesive is applied as outsole cement at least in a subregion of the outsole which is closed in the direction of the sole periphery and lies opposite the gauze strip after the adhesive attachment of the outsole.

44. Process according to claim 39, in which reactive hot-melt adhesive is applied to the outsole in that region which lies opposite the region of the functional-layer end region to be sealed after the outsole has been pressed onto the upper-end-region outer side, and otherwise conventional outsole cement is applied.

45. Process according to claim 39, in which reactive hot-melt adhesive is applied to the entire outsole.

46. Process according to claim 39, in which an expanding reactive hot-melt adhesive is applied to the outsole at least in that region which lies opposite the region of the functional-layer end region to be sealed after the outsole has been pressed onto the upper-end-region outer side.

47. Process according to claim 39, in which a reactive hot-melt adhesive which can be cured by means of moisture is used, which adhesive is applied to the region to be cemented and is exposed to moisture for reacting.

48. Process according to claim 39, in which a reactive hot-melt adhesive which can be thermally activated and can be cured by means of moisture is used, which adhesive is thermally activated, applied to the region to be cemented and is exposed to moisture for reacting.

49. Process according to claim 39, in which a thermoplastic is added to the reactive hot-melt adhesive before using the latter.

50. Process according to claim 39, in which the outer-material end region is fixed to the functional-layer end region before the outsole is cemented on.

* * * * *